US009062485B2

(12) United States Patent
Guidos et al.

(10) Patent No.: US 9,062,485 B2
(45) Date of Patent: Jun. 23, 2015

(54) ARTICULATING ROLLER ARM ASSEMBLY

(76) Inventors: Michael John Guidos, Lake Arrowhead, CA (US); Christopher Marshal Kee, Glendora, CA (US); Michael Henry Clark, Alta Loma, CA (US)

( * ) Notice: Subject to any disclaimer, the term of this patent is extended or adjusted under 35 U.S.C. 154(b) by 968 days.

(21) Appl. No.: 12/831,199

(22) Filed: Jul. 6, 2010

(65) Prior Publication Data

US 2011/0005140 A1 Jan. 13, 2011

Related U.S. Application Data

(60) Provisional application No. 61/223,453, filed on Jul. 7, 2009.

(51) Int. Cl.

| | |
|---|---|
| ***A47K 3/00*** | (2006.01) |
| ***E05D 15/06*** | (2006.01) |
| ***A47K 3/30*** | (2006.01) |
| ***A47K 3/34*** | (2006.01) |

(52) U.S. Cl.

CPC ..... *E05D 15/063* (2013.01); *A47K 3/30* (2013.01); *A47K 3/34* (2013.01); *E05D 15/0656* (2013.01); *E05D 15/0669* (2013.01); *E05Y 2201/64* (2013.01); *E05Y 2201/684* (2013.01); *E05Y 2600/10* (2013.01); *E05Y 2800/266* (2013.01); *E05Y 2900/114* (2013.01); *E05Y 2600/31* (2013.01); *E05Y 2800/296* (2013.01)

(58) Field of Classification Search

USPC ..... 4/607, 610; 384/57, 58, 59; 49/409, 49/410, 411

See application file for complete search history.

(56) References Cited

U.S. PATENT DOCUMENTS

| | | | |
|---|---|---|---|
| 1,656,410 | A | 1/1928 | Baer et al. |
| 1,781,692 | A | 11/1930 | Lewis |
| 1,854,443 | A | 4/1932 | Barce |
| 1,873,424 | A | 8/1932 | Kerr et al. |
| 2,394,667 | A | 2/1946 | Dailey |
| 2,610,367 | A | 9/1952 | Nordahl |
| 2,677,268 | A | 5/1954 | Hobbs |
| 2,815,543 | A | 12/1957 | Gates |
| 2,980,969 | A | 4/1961 | Tinfow |
| 3,037,555 | A | 6/1962 | Kochanowski |
| 3,102,581 | A | 9/1963 | Kochanowski |
| 3,335,784 | A | 8/1967 | Risk et al. |
| 3,422,464 | A | 1/1969 | O'Brien |
| 3,562,956 | A | 2/1971 | Johnson, Jr. |

(Continued)

FOREIGN PATENT DOCUMENTS

GB 2182085 5/1987

OTHER PUBLICATIONS

Photos of rollers.

(Continued)

*Primary Examiner* — Lauren Crane
(74) *Attorney, Agent, or Firm* — Patent Law Agency, LLC; Peter Ganjian

(57) ABSTRACT

An articulating roller arm assembly comprising a single integral piece cantilever beam with a span section and a throw section, with the span section oriented substantially transverse the throw section. A first distal end of the throw section and a distal end of the span section form a bend of the single integral piece cantilever beam. The articulating roller arm assembly further including a first wheel that is coupled with a first distal end of the throw section, and a second wheel that is coupled with a second distal end of the throw section.

13 Claims, 34 Drawing Sheets

(56) References Cited

U.S. PATENT DOCUMENTS

| | | | | |
|---|---|---|---|---|
| 3,744,827 | A | | 7/1973 | Cox |
| 3,879,912 | A | | 4/1975 | Cox |
| 3,942,197 | A | | 3/1976 | Sudmann et al. |
| 4,014,377 | A | | 3/1977 | Kochanowski |
| 4,014,378 | A | | 3/1977 | Kochanowski |
| 4,060,267 | A | | 11/1977 | Monfardini |
| 4,089,135 | A | | 5/1978 | Beny et al. |
| 4,115,900 | A | | 9/1978 | Mihalcheon |
| 4,152,789 | A | | 5/1979 | Heath |
| 4,256,164 | A | | 3/1981 | Agcaoili |
| 4,316,295 | A | | 2/1982 | Whitney et al. |
| 4,458,449 | A | | 7/1984 | Breuer |
| 4,473,911 | A | | 10/1984 | Germain |
| 4,480,862 | A | | 11/1984 | Fleming |
| 4,484,411 | A | | 11/1984 | Rystad |
| 4,653,127 | A | | 3/1987 | Baus |
| 4,671,026 | A | | 6/1987 | Wissinger |
| 4,769,862 | A | | 9/1988 | Skrzelowski |
| 4,807,312 | A | | 2/1989 | Baus |
| 4,882,795 | A | * | 11/1989 | Baus ..... 4/607 |
| 4,901,380 | A | | 2/1990 | Smith |
| 5,083,822 | A | | 1/1992 | Mangin et al. |
| 5,103,531 | A | | 4/1992 | Perrotta |
| 5,311,707 | A | | 5/1994 | LaRoche et al. |
| 5,473,843 | A | | 12/1995 | LaRoche et al. |
| 5,622,017 | A | | 4/1997 | Lynn et al. |
| 5,657,581 | A | | 8/1997 | Husting |
| D397,928 | S | | 9/1998 | Wise |
| 5,852,837 | A | | 12/1998 | Husting |
| 5,860,264 | A | | 1/1999 | Gephart et al. |
| 5,906,403 | A | | 5/1999 | Bestlet et al. |
| 5,908,064 | A | * | 6/1999 | Bruce ..... 160/202 |
| 6,006,375 | A | | 12/1999 | Carr |
| 6,023,889 | A | | 2/2000 | Husting et al. |
| 6,082,499 | A | * | 7/2000 | O'Donnell ..... 187/324 |
| 6,094,757 | A | | 8/2000 | Torres |
| 6,109,666 | A | | 8/2000 | Collet |
| 6,216,287 | B1 | | 4/2001 | Wise |
| 6,470,511 | B1 | | 10/2002 | Smale |
| 6,491,326 | B1 | | 12/2002 | Massey et al. |
| 6,691,339 | B1 | | 2/2004 | Thomas |
| 6,698,037 | B2 | | 3/2004 | Lippe |
| 6,817,144 | B1 | | 11/2004 | Tavivian |
| 6,851,133 | B1 | | 2/2005 | Nehring |
| 6,990,695 | B2 | | 1/2006 | Grayson |
| 7,028,349 | B2 | | 4/2006 | Helmetsie et al. |
| 7,174,944 | B1 | | 2/2007 | Guidos et al. |
| 7,225,480 | B2 | | 6/2007 | Mascheron |
| 7,377,076 | B2 | | 5/2008 | Shedd |
| 7,591,492 | B2 | | 9/2009 | Nikkhah |
| 7,634,823 | B2 | | 12/2009 | Sisk |
| 7,694,358 | B2 | | 4/2010 | Stimpson |
| 7,735,795 | B2 | | 6/2010 | Wronski |
| 7,849,531 | B2 | | 12/2010 | Rooke et al. |
| 7,856,771 | B2 | | 12/2010 | Guidos et al. |
| 8,037,556 | B2 | | 10/2011 | Lock et al. |
| 8,069,506 | B2 | | 12/2011 | Hammond |
| 2002/0157325 | A1 | | 10/2002 | Domanico |
| 2002/0163203 | A1 | | 11/2002 | Donald |
| 2003/0188379 | A1 | | 10/2003 | Cowell et al. |
| 2004/0003484 | A1 | | 1/2004 | D'Assumcao |
| 2005/0177936 | A1 | | 8/2005 | Graells Pane |
| 2008/0047057 | A1 | | 2/2008 | Ho |
| 2008/0202056 | A1 | | 8/2008 | Jantzen |
| 2008/0250558 | A1 | | 10/2008 | Torres |
| 2009/0038070 | A1 | | 2/2009 | Belanger et al. |
| 2009/0056077 | A1 | | 3/2009 | Belanger et al. |
| 2009/0211175 | A1 | | 8/2009 | Guidos |
| 2010/0147042 | A1 | | 6/2010 | Chen |
| 2010/0281612 | A1 | | 11/2010 | Cook |
| 2010/0293708 | A1 | | 11/2010 | Hildebrandt |
| 2011/0005140 | A1 | | 1/2011 | Guidos et al. |
| 2011/0083393 | A1 | | 4/2011 | Guidos et al. |
| 2011/0094686 | A1 | | 4/2011 | Kee et al. |
| 2011/0203046 | A1 | | 8/2011 | Donnelly et al. |
| 2011/0283624 | A1 | | 11/2011 | Baer |
| 2011/0291848 | A1 | | 12/2011 | Burdenko |
| 2012/0023658 | A1 | | 2/2012 | Bobeck et al. |
| 2012/0198655 | A1 | | 8/2012 | Lapping |

OTHER PUBLICATIONS

Photos of enclosures; the photos were taken on Jul. 6, 2011.
Photo of adjustable roller; http://cqyqgd.en.made-in-china.com/.
Photo of broken hinge roller.
Photo of garage door roller; Pub. 2006.
Photo of Roller-Hinge replacement.
Pictures of Known Related Rollers for Shower Doors.
http://www.raumplusna.com/air ; Sliding door system-AIR product list and system description, including accessories ; 2013.
http://www.contractorswardrobe.com/instructions_all.html ; Door Panel Model #5000-45-45; assembly and installation instructions.
mobilehomepartsstore.com ; Kinro Vinyl Sliding Patio Door; 2002-2012.

* cited by examiner

ARTICULATING ROLLER ARM ASSEMBLY

CROSS-REFERENCE TO RELATED APPLICATIONS

This application claims the benefit of priority of the U.S. Utility Provisional Patent Application No. 61/223,453, filed 7 Jul. 2009, the entire disclosure of which is expressly incorporated by reference herein.

BACKGROUND OF THE INVENTION

1. Field of the Invention

The invention relates to shower doors and, more particularly, to shower door rollers that enable stable articulation and maximum displacement of the shower doors.

2. Description of Related Art

Most conventional corner showers have a generally rounded framed with a set of fixed and sliding panels forming doors that are held in a rail or track at the top and the bottom of the shower, with a handle provided on the door(s) to slide (or move) the sliding panels to one of a closed or open positions to create a passageway to enter the shower area. In general, shower door rollers are typically mounted on the sliding panels and are inserted in the rail or track to enable the sliding panels to roll on the tracks to open and closed positions.

Regrettably, most conventional rollers limit the articulation span of the sliding panels of the shower door and additionally, have no means to reduce or eliminate in-plane and out-of-plane movement of the sliding panels during operations of closing and opening of the sliding doors.

Accordingly, in light of the current state of the art and the drawbacks to current rollers, a need exists for a roller that would not limit the travel distance of the shower doors, and would not reduce their stability during their move.

BRIEF SUMMARY OF THE INVENTION

An optional exemplary aspect of the present invention provides an articulating roller assembly, comprising:

a cantilever beam, having:

a throw section and a span section;

the throw section is oriented substantially transverse the span section;

a first distal end of the span section and a distal end of the throw section form a bend of the cantilever beam; and a first wheel that is coupled with a first distal end of the span section, and a second wheel that is coupled with a second distal end of the span section.

Another optional exemplary aspect of the present invention provides an articulating roller assembly, wherein:

the first wheel has a first rotational plane and the second wheel has a second rotational plane, where the first rotational plane is at an angle in relation with the second rotational plane.

Another optional exemplary aspect of the present invention provides an articulating roller assembly, wherein:

the span section is substantially longer than the throw section.

Yet another optional exemplary aspect of the present invention provides an articulating roller assembly, wherein:

the formed bend constitutes an corner-elbow section of the cantilever beam, forming a substantially L-shaped beam with the span section and the throw section as the extremities of the L-shaped beam.

A further optional exemplary aspect of the present invention provides an articulating roller assembly, wherein:

the formed bend constitutes a rounded corner-elbow section of the cantilever beam, forming a substantially rounded L-shaped beam with the span section and the throw section as the extremities of the rounded L-shaped beam.

Still a further optional exemplary aspect of the present invention provides an articulating roller assembly, wherein:

the throw section includes a connecting distal end that couples the cantilever beam to a roller support.

Yet a further optional exemplary aspect of the present invention provides an articulating roller assembly, wherein:

the roller support is comprised of:

a channel for mounting the roller support onto a frame of an enclosure;

a set of apertures for securely fastening the mounted roller support to the frame of the enclosure.

Another optional exemplary aspect of the present invention provides an articulating roller assembly, wherein:

the roller support houses an adjustment shaft for vertical adjustment of the cantilever beam in relation to the roller support.

Yet another optional exemplary aspect of the present invention provides an articulating roller assembly, wherein:

the channel is inserted within a periphery notch of the frame of the enclosure, positioning the adjustment shaft at an interior side of an enclosed area of the enclosure, which facilitate quick and easy access for adjustment of the adjustment shaft.

Still another optional exemplary aspect of the present invention provides an articulating roller assembly, wherein:

the connecting distal end of the throw section is pivotally coupled with the adjustment shaft, enabling the throw section to rotate and swing along a reciprocating path within a cavity of the roller support.

A further optional exemplary aspect of the present invention provides an articulating roller assembly, wherein:

the adjustment shaft supports the throw section, which rotates about a longitudinal axis of the shaft.

Another optional exemplary aspect of the present invention provides an articulating roller assembly for maximizing travel span and stability of a shower door operation, comprising:

a cantilever beam that includes:

a throw section having a longitudinal axis that maintains a fixed perpendicular distance between a raceway of a support rail and the shower door;

the throw section stabilizes out-of-plane motions of the shower door, and delimits in-plane vertical motions thereof;

a span section that supports a set of wheels coupled at a first and second distal ends of the span section with sufficient longitudinal separation between wheels;

the span section is oriented substantially transverse the throw section; and a first distal end of the span section and a distal end of the throw section form a bend of the cantilever beam.

Yet another optional exemplary aspect of the present invention provides an articulating roller assembly for maximizing travel span and stability of a shower door operation, wherein:

the throw section further includes a connecting distal end that pivotally couples the cantilever beam with an adjustment shaft of a roller support.

Another optional exemplary aspect of the present invention provides a shower enclosure, comprising:

a quadrant shower substrate with curved and straight sections includes a horizontal surface along an exterior periphery that is comprised of a first substantially straight section, an arched mid-section, and a second substantially straight section;

a first vertically oriented inner wall jamb and a second vertically oriented inner wall jamb associated with the shower substrate include a raceway along their respective longitudinal axis, and have a substantially U shaped cross-section, with an outer flat side of the raceway coupled with a surround;

a frame that is configured along a lateral axis substantially commensurate with the exterior periphery of the shower substrate;

the frame is comprised of a header and a sill that have substantially straight portions and a curved mid-portion configured commensurate with the exterior periphery of the shower substrate;

the frame further includes a first outer wall jamb and a second outer wall jamb that are vertically oriented and perpendicular to the header and sill, which couple with a first and a second distal ends of the header and sill by a set of fasteners, the combination of which form a four-sided frame, which is coupled with the first and second inner wall jambs;

fixed panels that are coupled with the substantially straight portions of the header and sill;

the fixed panels are comprised of at least one held-in-place fastener for facilitating installation of the fixed panel onto the frame of the shower enclosure;

the held-in-place fastener is comprised of a fastener holding mechanism with sufficient bulk to enable the holding mechanism to snug fit in between spaces within a channel of a fixed panel frame;

rolling doors having a curved lateral axis that is configured substantially commensurate with the arched mid-portions of the header and the sill, and a vertical length that is parallel along a longitudinal axis of the rolling doors, substantially commensurate with a vertical distance between the header 402 and the sill 406;

the rolling doors and are comprised of a rolling door frame having a top rolling door frame member, a bottom rolling door frame member, and lateral rolling door frame members that enclose a closure, with the frame and the closure constituting the rolling doors;

the top and bottom rolling frame members include notches that house an articulating roller arm assembly that ride along a track of the header and sill of the frame, with the articulating roller arm assembly including:

a cantilever beam, having:

a throw section and a span section;

the throw section is oriented substantially transverse the span section;

a first distal end of the span section and a distal end of the throw section form a bend of the cantilever beam; and a first wheel that is coupled with a first distal end of the span section, and a second wheel that is coupled with a second distal end of the span section.

Such stated advantages of the invention are only examples and should not be construed as limiting the present invention. These and other features, aspects, and advantages of the invention will be apparent to those skilled in the art from the following detailed description of preferred non-limiting exemplary embodiments, taken together with the drawings and the claims that follow.

BRIEF DESCRIPTION OF THE DRAWINGS

It is to be understood that the drawings are to be used for the purposes of exemplary illustration only and not as a definition of the limits of the invention. Throughout the disclosure, the word "exemplary" is used exclusively to mean "serving as an example, instance, or illustration." Any embodiment described as "exemplary" is not necessarily to be construed as preferred or advantageous over other embodiments.

Referring to the drawings in which like reference character(s) present corresponding part(s) throughout.

DETAILED DESCRIPTION OF THE INVENTION

The detailed description set forth below in connection with the appended drawings is intended as a description of presently preferred embodiments of the invention and is not intended to represent the only forms in which the present invention may be constructed and or utilized.

Figure 1:
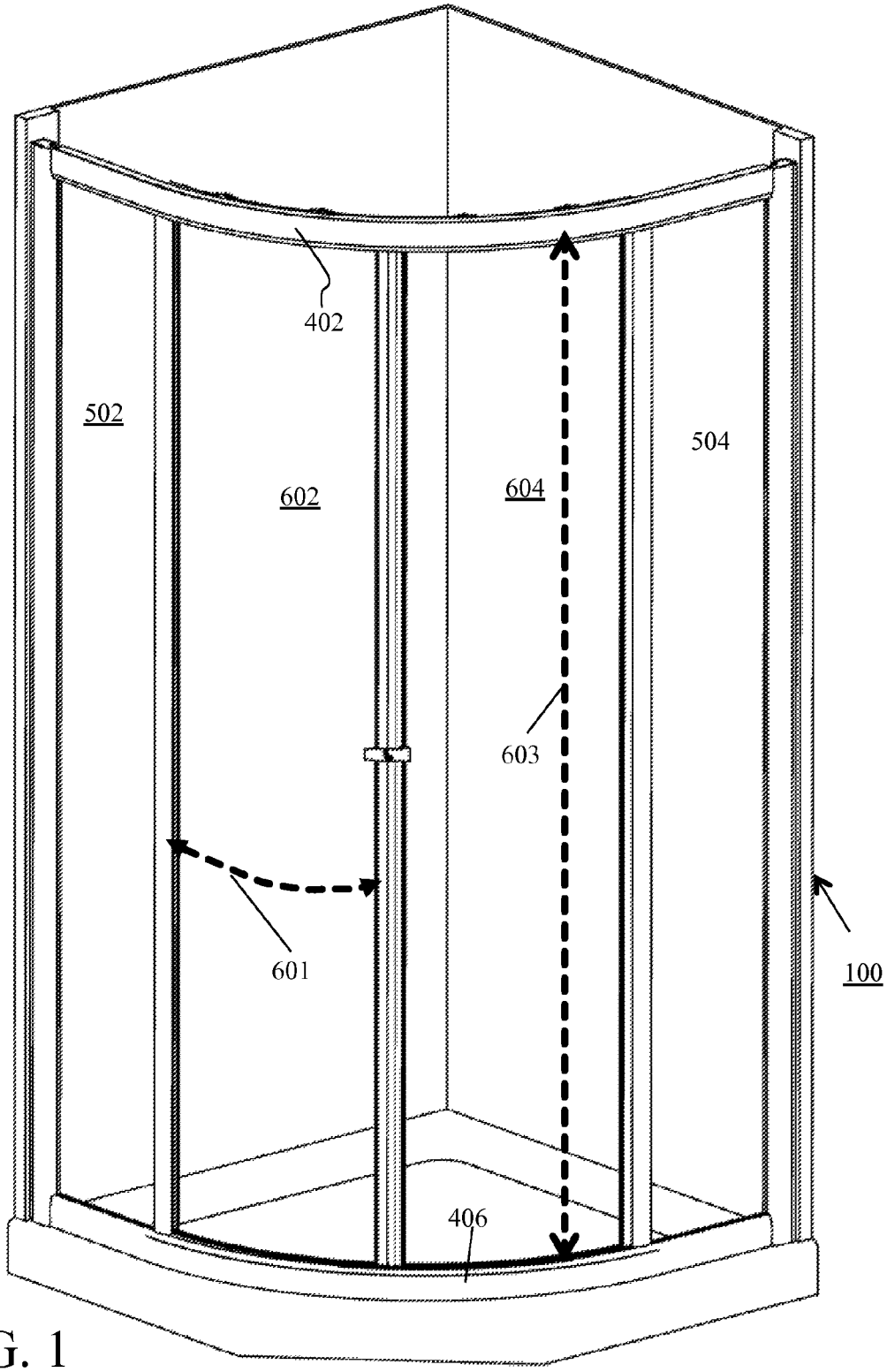
FIG. 1 is an exemplary illustration of a shower enclosure that uses an articulating roller arm assembly of the present invention.

The present invention provides a new articulating roller arm assembly that greatly increases the overall stability of a curved door that moves along both a curved and straight track system, while enabling maximum articulation (or opening) and maintaining proper door function. FIG. 1 is an exemplary illustration of a shower enclosure that uses the articulating roller arm assembly of the present invention. As illustrated in FIG. 1, the present invention provides a shower enclosure 100 for a quadrant shower pan or substrate (with curved and straight sections) that allows for a wider ingress to and egress from a shower area. The articulating roller arm assembly 606 of the present invention enables the shower enclosure 100 rolling doors 602 and 604 to roll along to the very distal ends 412 and 414 of a reciprocating path of a track 806 of a header 402 and a sill 406 of a frame 416 of the shower enclosure 100, rolling past the fixed panels 502 and 504. This enables the rolling doors 602 and 604 to open wider (FIG. 5A) than that of the conventional doors, improving ingress and egress from the shower area and stable articulation.

Figure 2:
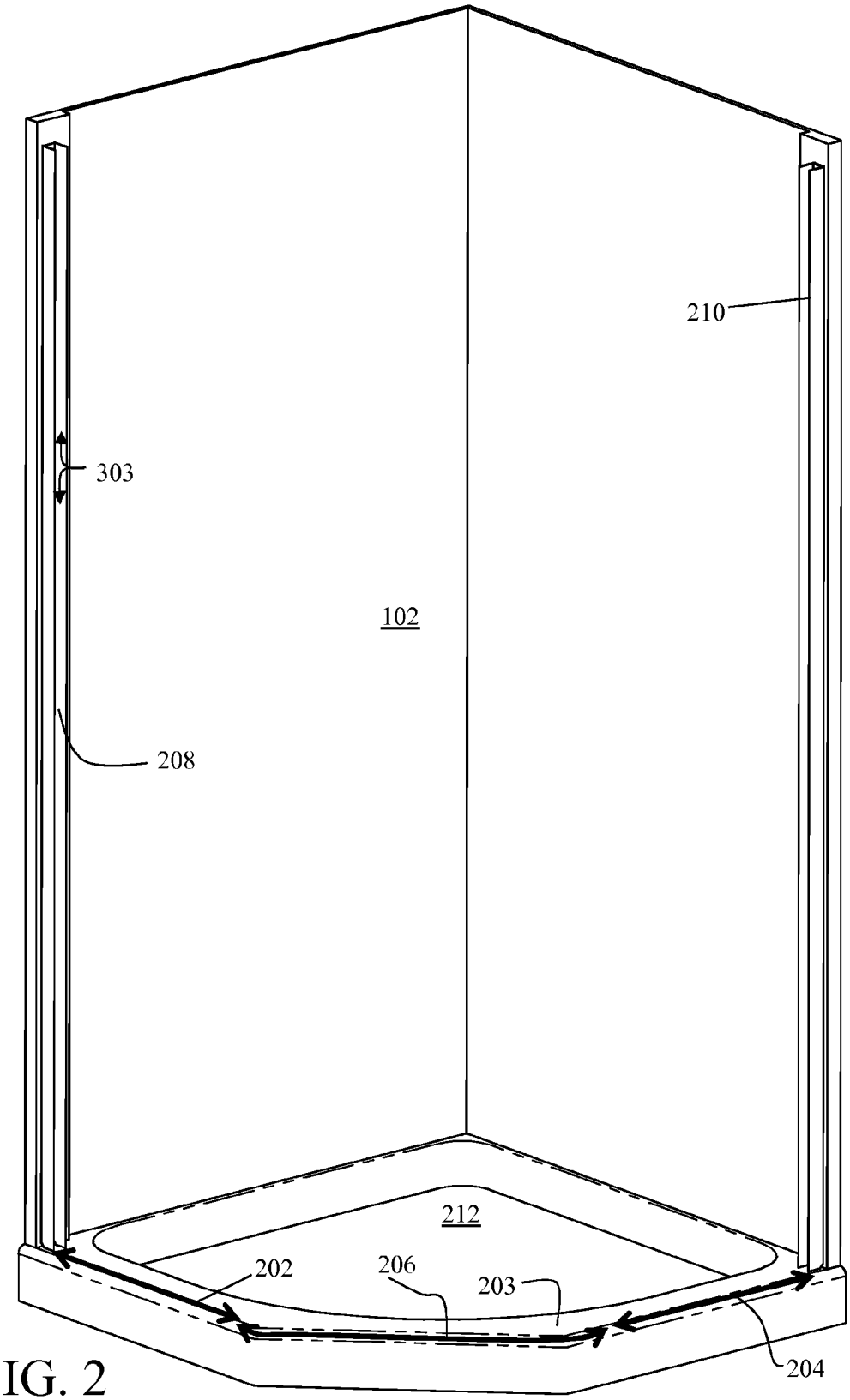
FIG. 2 is an exemplary illustration of an open shower area, including the shower substrate and surround of the shower enclosure of FIG. 1 in accordance with the present invention.

FIG. 2 is an exemplary illustration of the open shower area, including the shower substrate and surround of the shower enclosure of FIG. 1 in accordance with the present invention. As illustrated in FIG. 2, an exemplary shower pan (or substrate) 212 used by the present invention includes a horizontal surface along its exterior periphery (also known as "curb") 203 that is comprised of a first substantially straight (flat) section 202, an arched mid-section 206, and a second substantially straight (flat) section 204. The shower pan 212 is generally a water basin portion of the shower area that is positioned on top of the shower area flooring. As further illustrated, a surround 102 is provided that covers the walls to which the shower enclosure is coupled. The surround 102 can be a plastic wallboard, fiberglass, or the like. The present invention associates the shower pan 212 and the surround 102 with a first vertically oriented inner wall jamb 208 and a second vertically oriented inner wall jamb 210. The inner wall jambs 208 and 210 include a channel or raceway 303 along their respective longitudinal axis, and have a substantially U shaped cross-section, with the outer flat side of the raceway coupled with a surround 102.

Figure 3A:
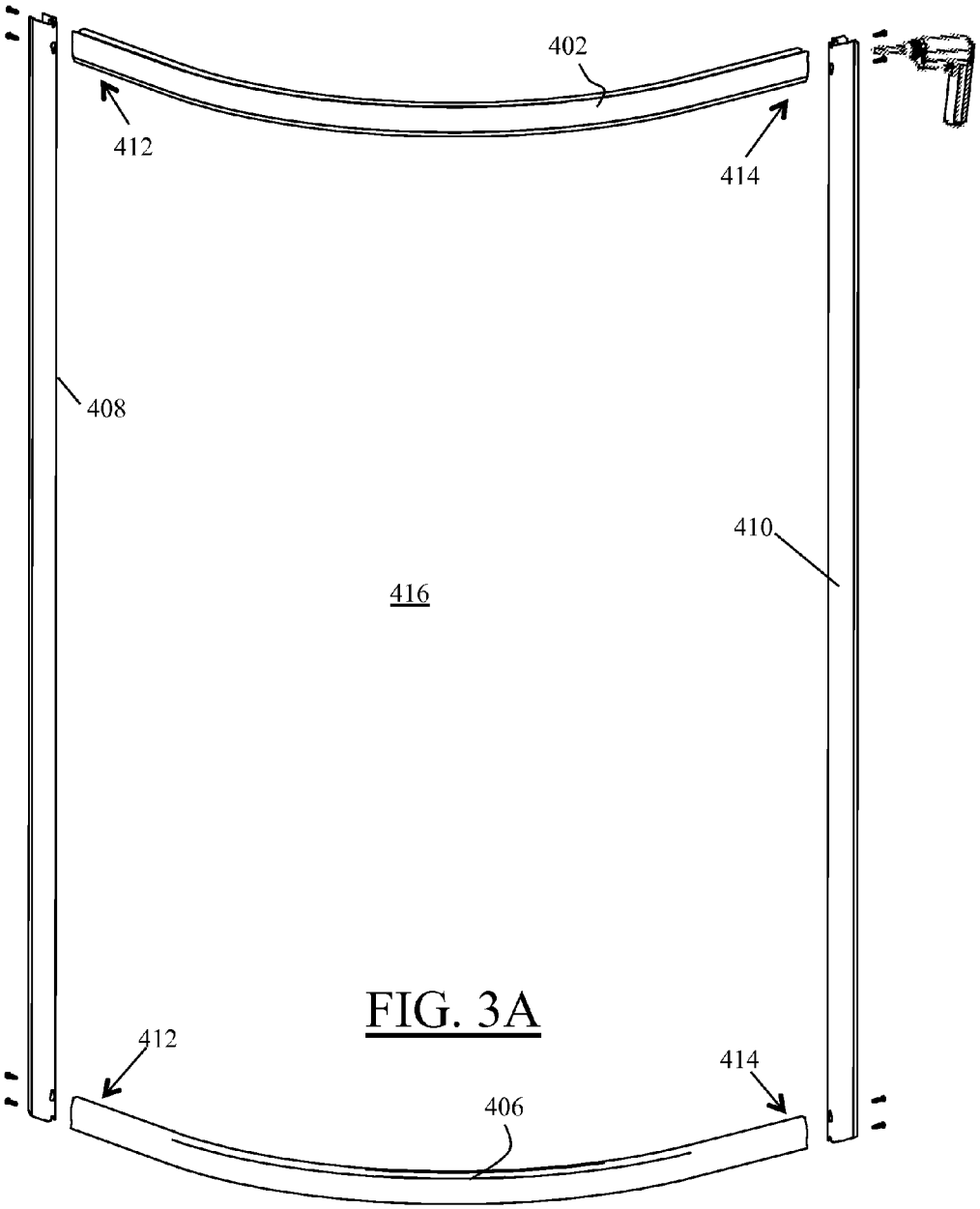
FIGS. 3A to 3C are exemplary illustrations of a frame of the shower enclosure illustrated in FIG. 1 in accordance with the present invention.
Figure 3B:
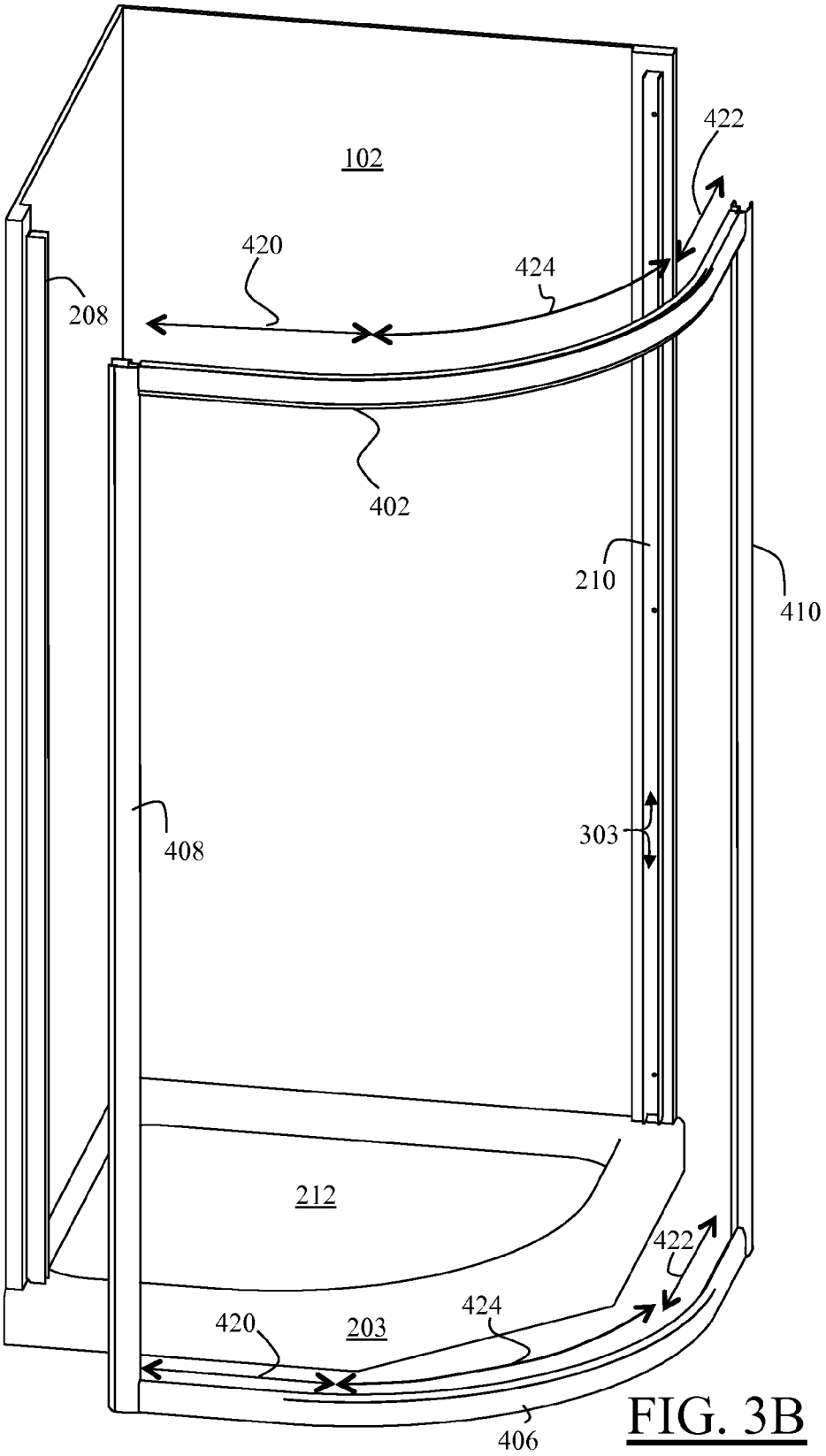
Figure 3C:
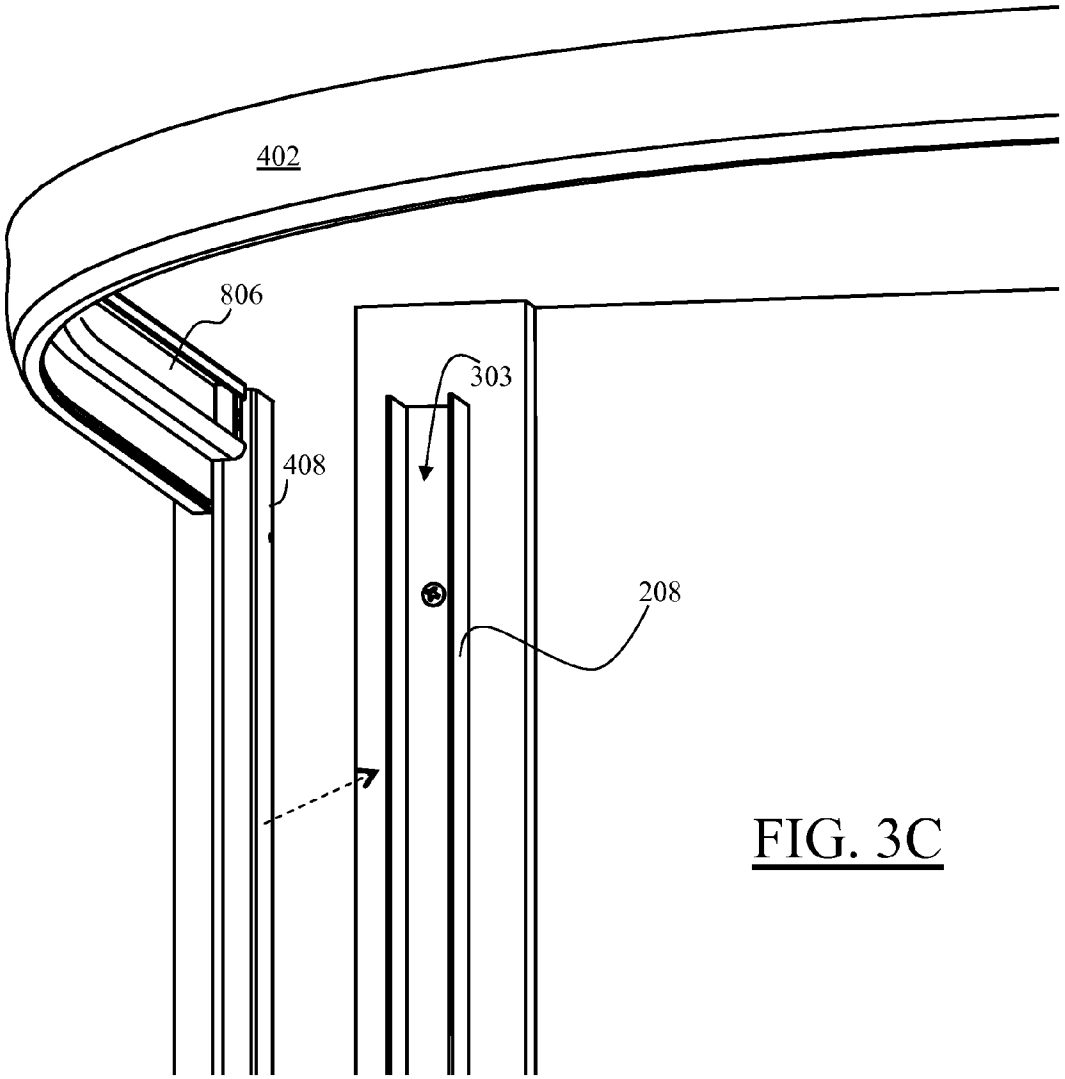

FIGS. 3A to 3C are exemplary illustrations of a frame of the shower enclosure illustrated in FIG. 1 in accordance with the present invention. The present invention provides a shower enclosure 100 that includes a frame 416 that is configured (along its lateral axis) substantially commensurate with the exterior periphery 203 of the shower pan 212 and the surround 102, including the position and orientation of the first inner wall jamb 208, and that of the second inner wall jamb 210. The frame 416 of the shower enclosure 100 is comprised of a header 402 at the top and a sill 406 at the bottom that have substantially straight portions 420 and 422 and an curved mid-portion 424 configured commensurate with the exterior periphery (or "curb") 203 of the shower pan 212. The frame 416 of the shower enclosure 100 further includes a first outer wall jamb 408 and a second outer wall jamb 410 that are vertically oriented and perpendicular to the header 402 and sill 406, which couple with a first 412 and a second 414 distal ends of the header 402 and sill 406 by a set of fasteners, the combination of which form the four-sided frame 416. Upon full assembly of the frame 416 (FIG. 3A) of the shower enclosure 100, the first and the second outer wall jambs 408 and 410 are placed over the channel or raceway 303 of the respective first and second inner wall jambs 208 and 210 (FIG. 3C).

Figure 4A:
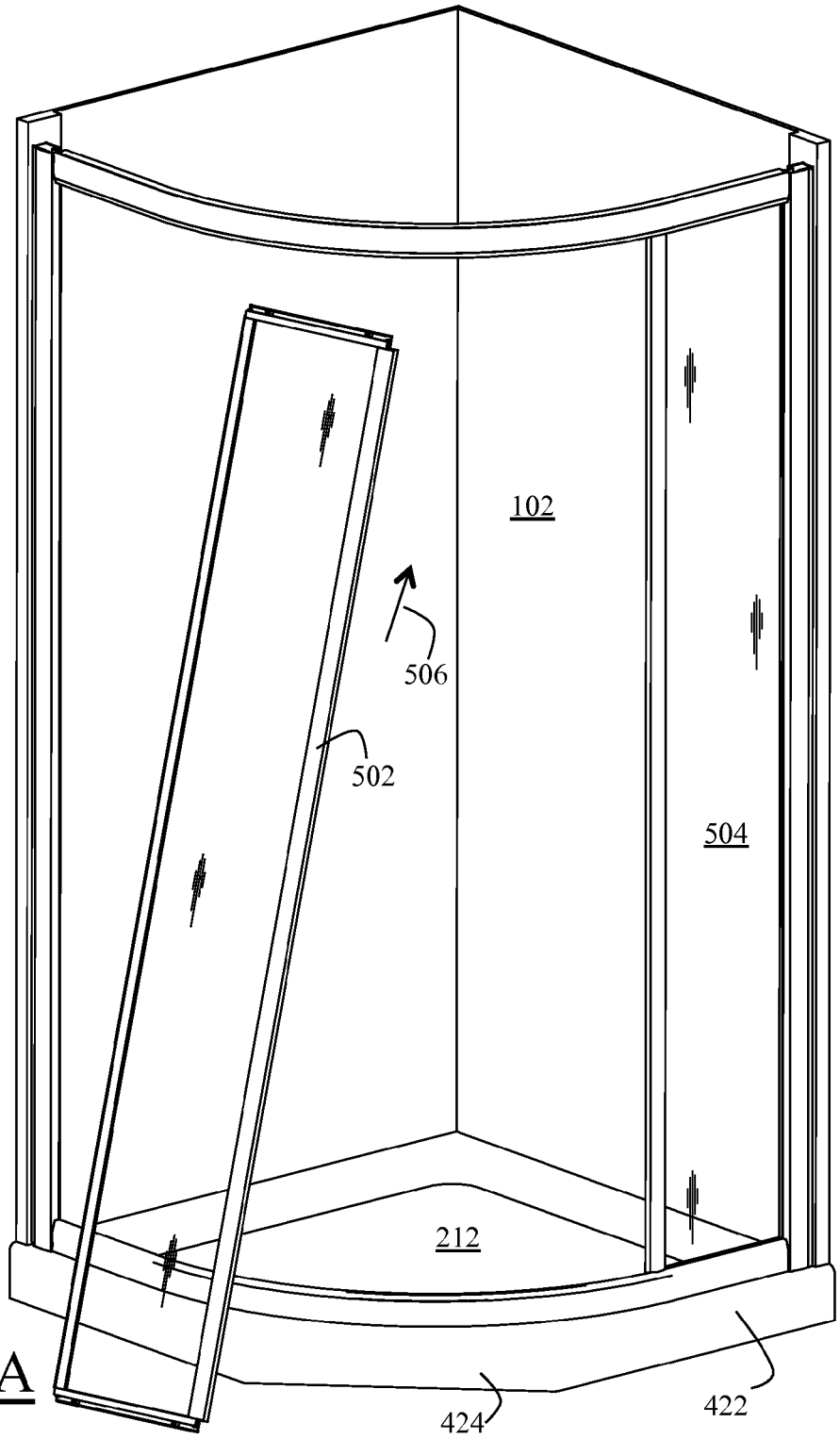
FIGS. 4A to 4E are exemplary illustrations of fixed panels of the shower enclosure of FIG. 1, including the assembly thereof in accordance with the present invention.
Figure 4B:
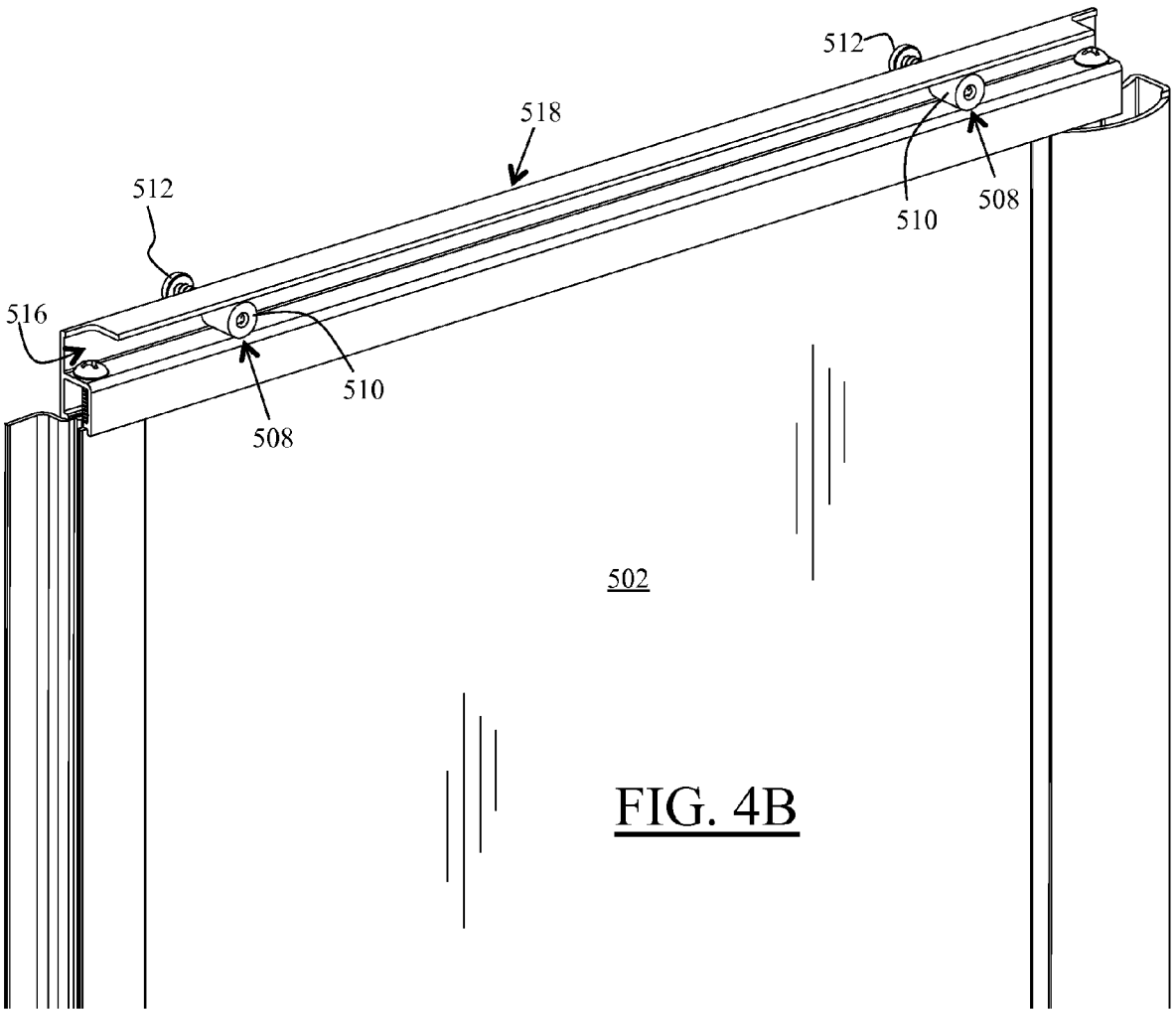
Figures 2, 4C:
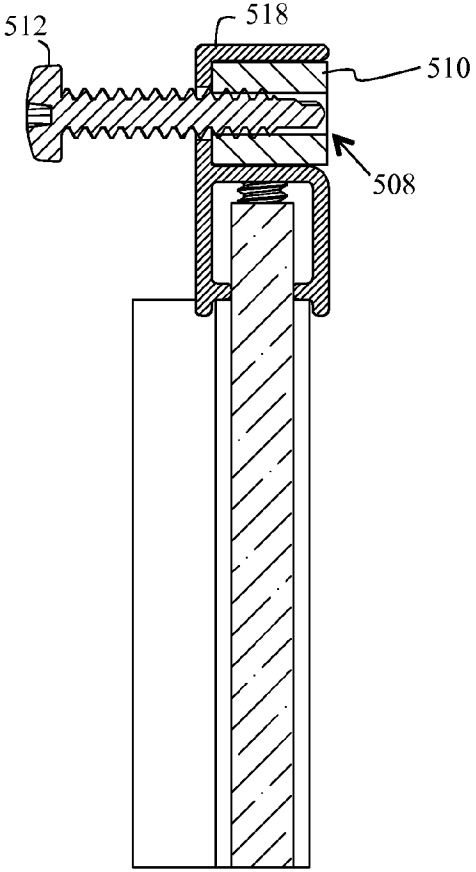
Figures 1, 4C:
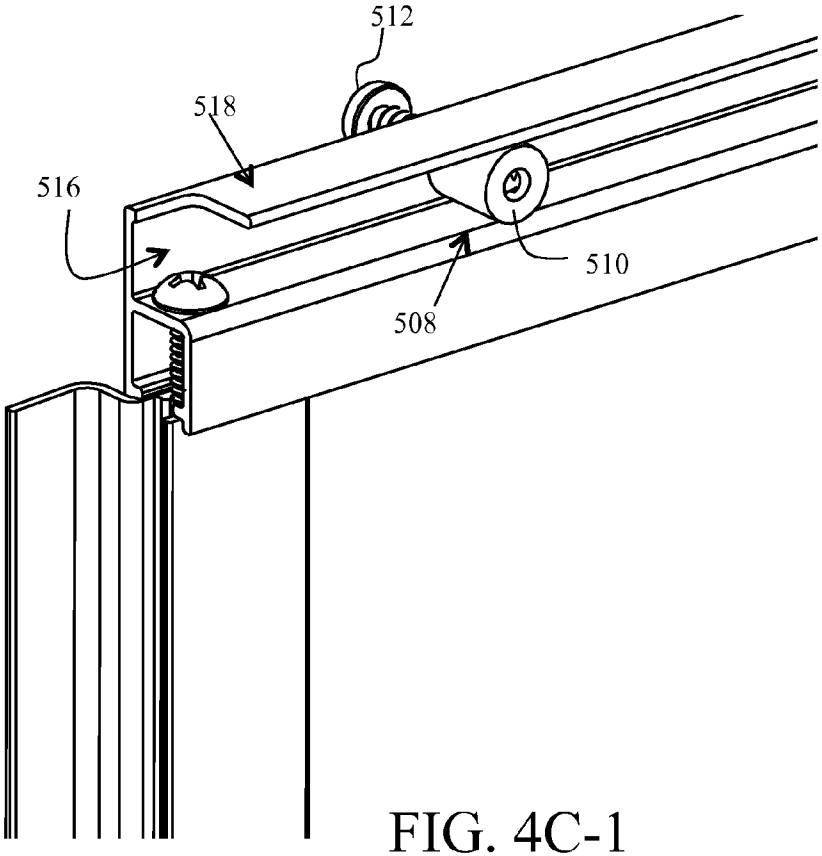
Figure 4D:
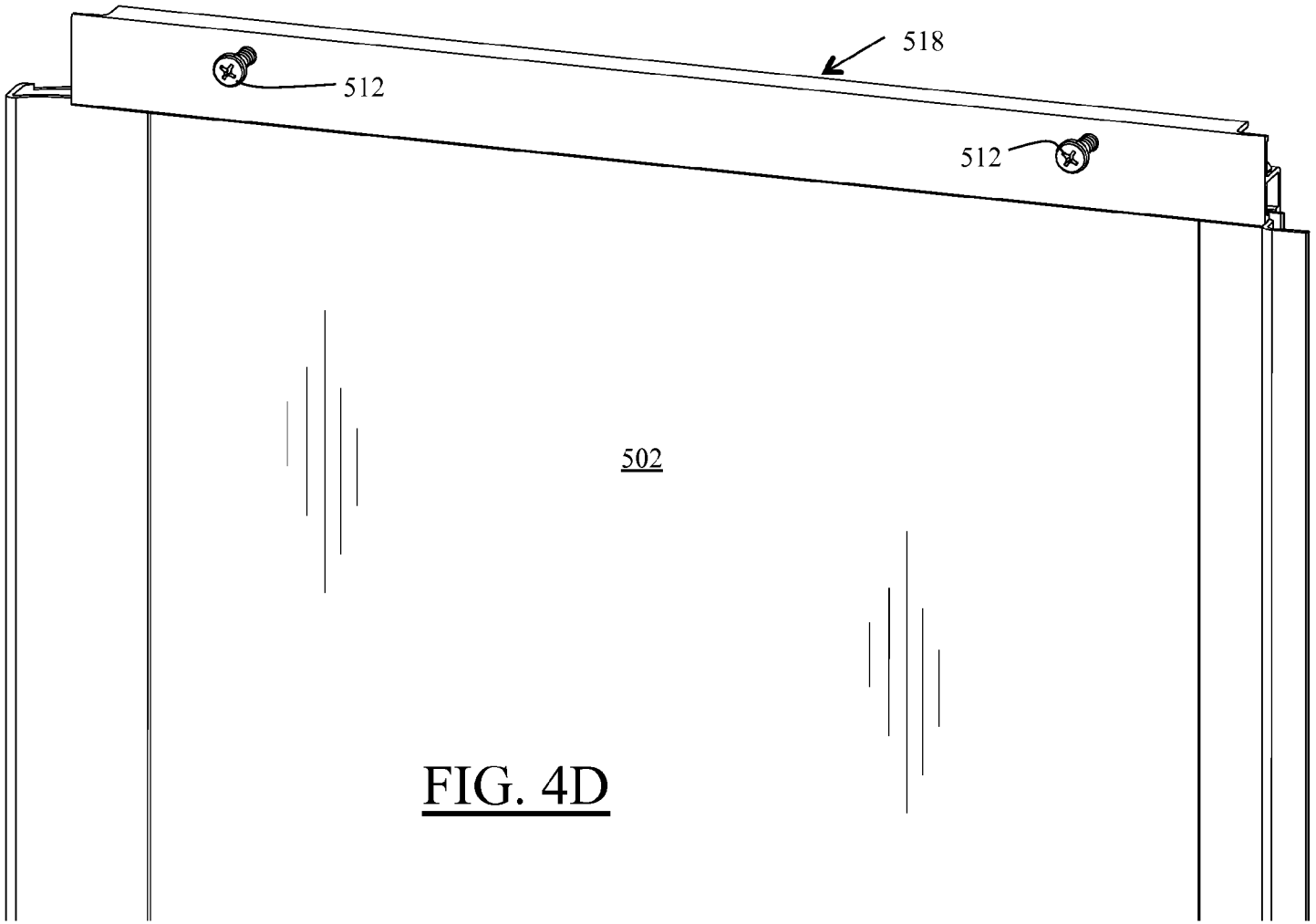
Figure 4E:
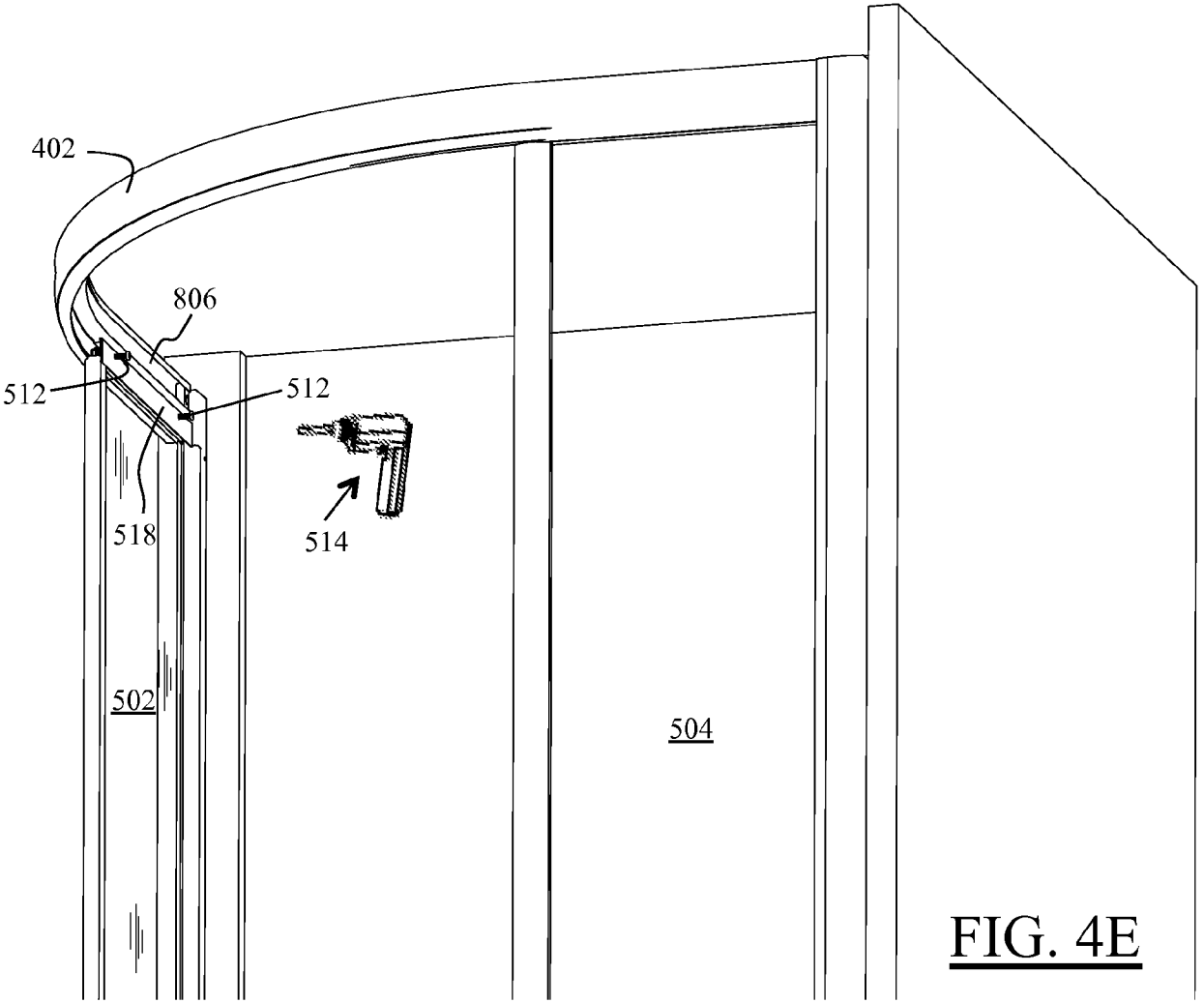

FIGS. 4A to 4E are exemplary illustration of fixed panels of the shower enclosure of FIG. 1, including the assembly thereof in accordance with the present invention. As illustrated, one or more fixed panels 502 and 504 are coupled with the substantially straight portions 420 and 422 of the header 402 and sill 406 of the frame 416. A fixed panel (e.g., 502) is maneuvered (indicated by arrows 506 of FIG. 4A) into the shower enclosure area, and coupled with the interior-facing surface of the straight portions 420 and 422 of the header 402 and sill 406 of the frame 416 of the shower enclosure 100. As best illustrated in FIGS. 4B to 4E, the fixed panels are comprised of at least one held-in-place fastener 508 for facilitating installation of the fixed panel onto the frame 416 of the shower enclosure 100. The held-in-place fastener 508 is comprised of a fastener holding mechanism 510 that holds a fastener 512 in its place and in a correct orientation for quickly fastening the fixed panel onto the frame 416 of the shower enclosure 100 without a user holding the fastener (FIG. 4E). The fastener holding mechanism 510 frees the users hands from holding the fastener 512 during installation and assembly, and instead, the users can hold and operate machinery 514 with one hand and hold the panel 502 itself with another hand for easy alignment and coupling of the panel onto the frame 416 of the shower enclosure 100. Therefore, there is no longer a need for the users to maintain the fastener 512 in a certain position and orientation because the holding mechanism 510 performs that function.

As further illustrated, the fastener holding mechanism 510 has sufficient bulk to enable it to snug fit in between spaces within voids or channel raceways 516 of the fixed panel frame 518, as illustrated. In other words, the bulk of the fastener holding mechanism 510 can maintain in place and in a proper position and orientation a fastener 512 by interference fit or by friction, and continue to allow it to fasten together products during installation. Stated otherwise, the holding mechanism 510 maintains the fasteners 512 in the proper position until and during time when the fasteners 512 are used to mount the fixed panels onto the frame 416 of the shower enclosure 100. The fastener holding mechanism 510 can be any shape and be configured of any material so long as it holds the fastener and allows the fastener to move within it to mount the fixed panel onto a frame. In this exemplary instance, the holding mechanism 510 is illustrated as having a soft, cylindrical disc configuration with transparent body and sufficient bulk to fit within the channel or raceway 516 of fixed panel frame 518 and hold the fastener 512 in proper position and orientation. Non-limiting example of materials from which the fastener holding mechanism 510 can comprise of may include wood, metal, magnetic, plastic, or any others so long as the holding mechanism 510 allows for movement (or penetration) of the fastener through to mount the panel onto the frame. None limiting examples of a preferred material may be those that are flexible such as a plastic (e.g., Poly Vinyl Chloride (PVC)), thermo plastic elastomer, rubber or anything that is soft. However, rigid material may also work. Transparency of the holding mechanism 510 (as illustrated) is preferred because the fastener 512 held within can be viewed as the fastener 512 is moved through the holding mechanism 510 to mount the fixed panel onto the frame. As indicated above, the main value of the fastener holder is that one hand is used to hold a machine (such as a drill 514) and the other is used to hold the panel in proper orientation in relation to the header and sill of the frame without worrying or having to hold any fastener. The application of the holding mechanism 510 is not limited to the present invention and may be used on anything that requires a fastener that cannot maintain its position and orientation independently.

Figure 5A:
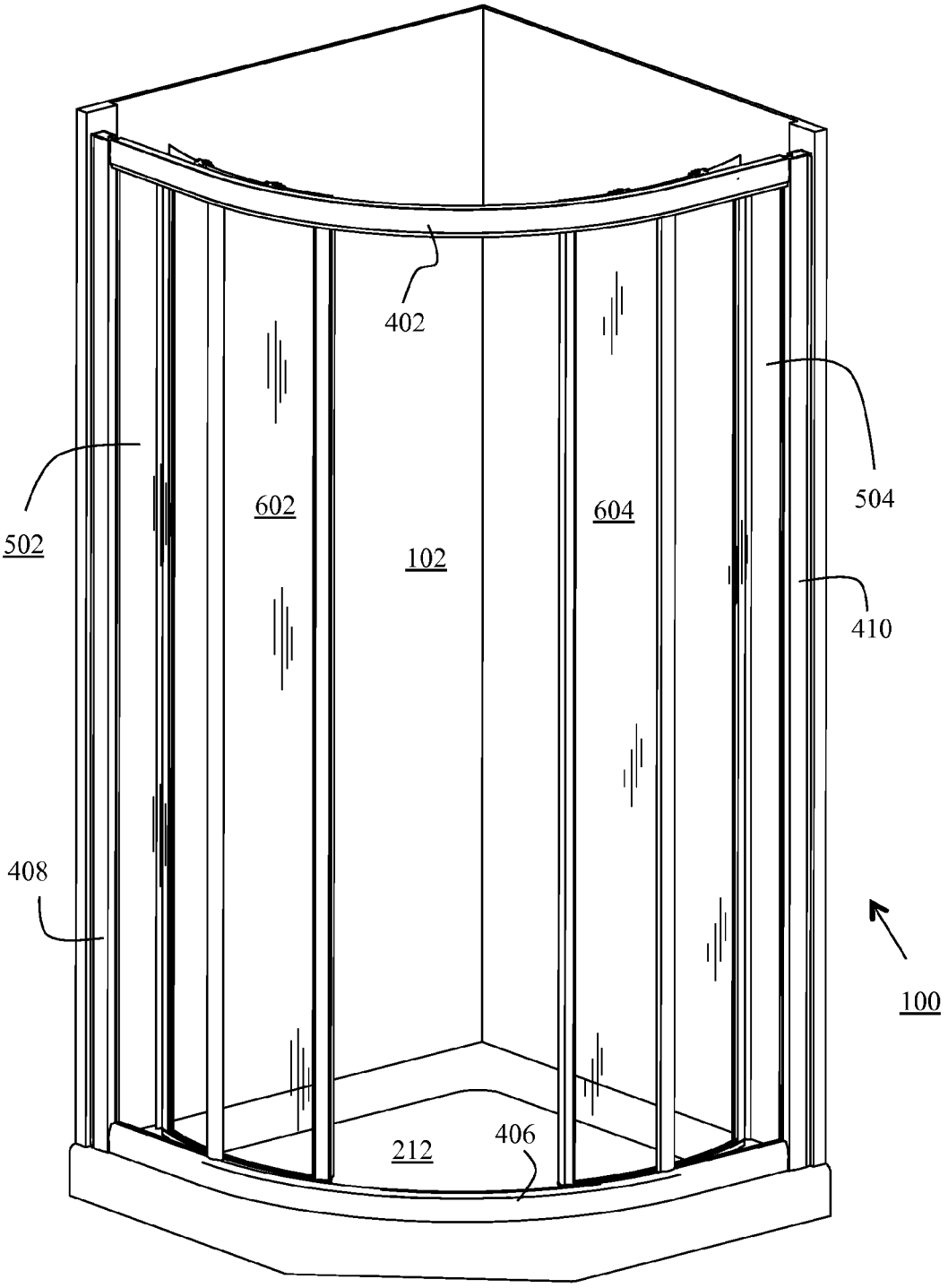
FIGS. 5A to 5C are exemplary illustrations of sliding (or rolling) doors of the shower enclosure of FIG. 1 in accordance with the present invention.
Figures 1, 5B:
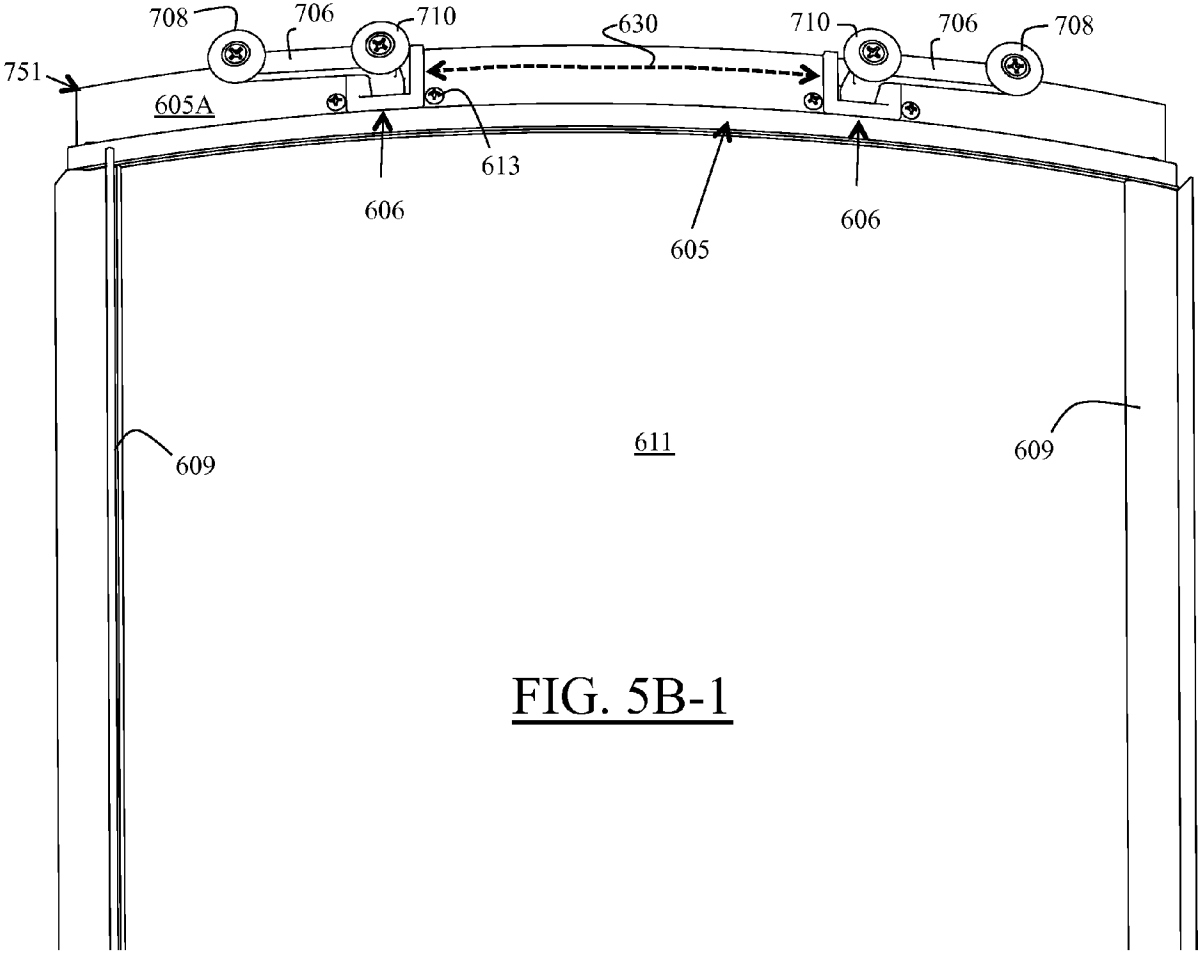
Figures 3, 5B:
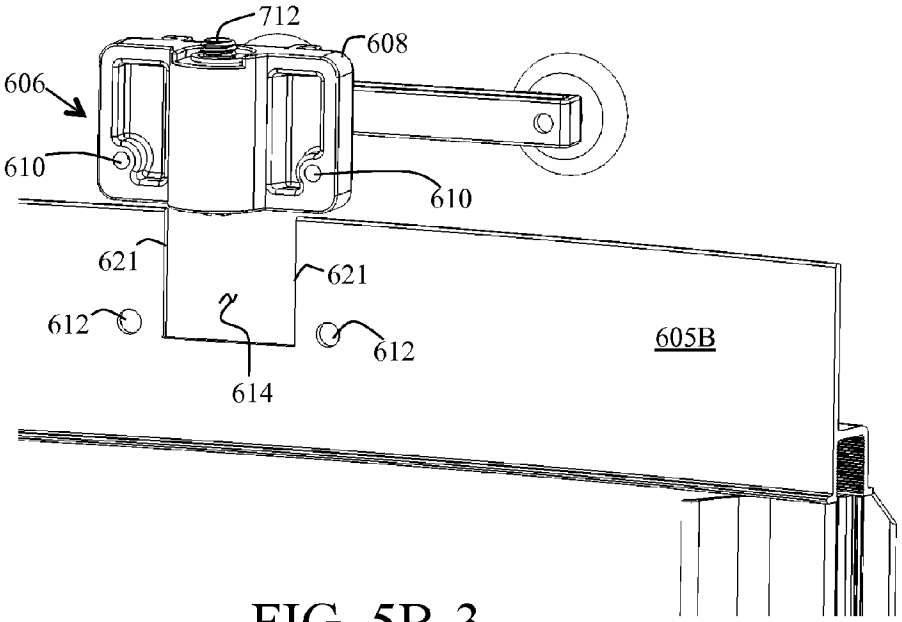
Figures 2, 5B:
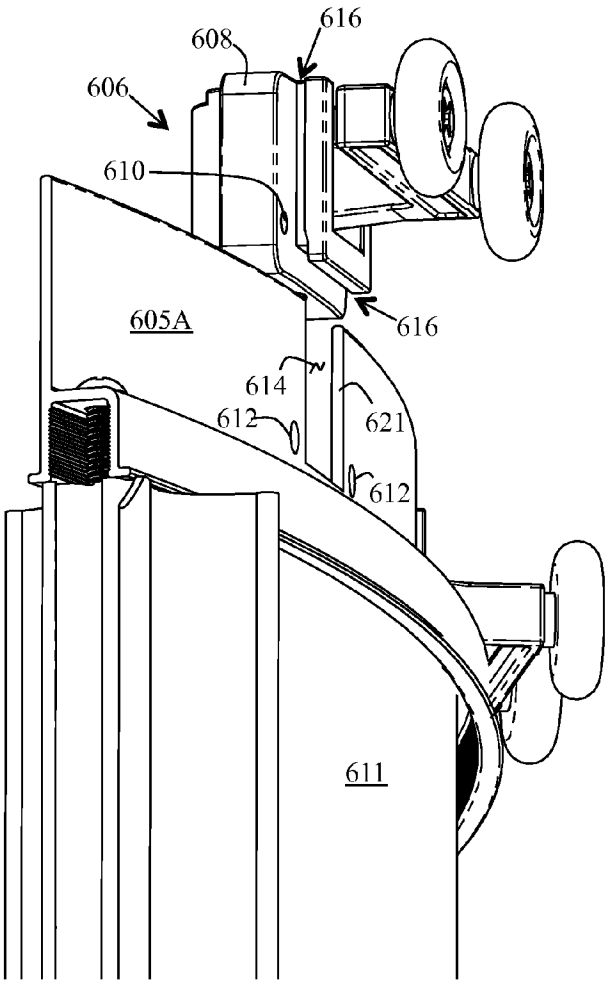
Figure 5C:
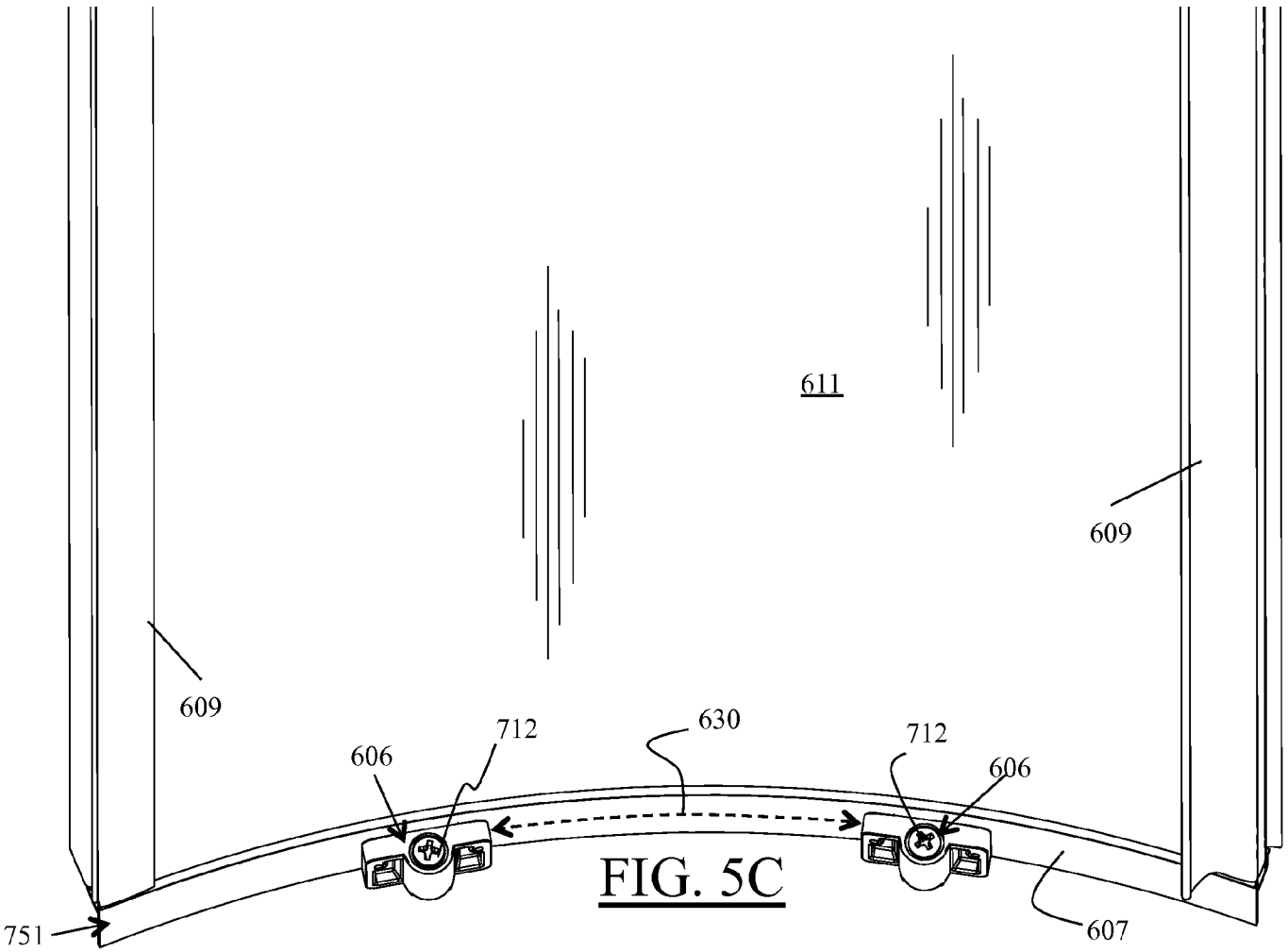

FIGS. 5A to 5C are exemplary illustrations of sliding (or rolling) doors of the shower enclosure of FIG. 1 in accordance with the present invention. FIG. 5A is an exemplary illustration of the shower enclosure of FIG. 1, with the roller doors in open position in accordance with the present invention. FIG. 5B-1 is an exemplary illustration of the top portion of a rolling door, viewed from the exterior side that faces outside of the shower area, with the bottom exterior portion being identical. FIG. 5B-2 is an exemplary view of an articulating roller arm assembly in the process of being assembled onto the roller door, shown from the exterior facing side of the top frame member in accordance with the present invention, with the exterior facing side of bottom being identical. FIG. 5B-3 is the same as that of FIG. 5B-2, but viewed from the interior facing side of the top frame member in accordance with the present invention, with the interior facing side bottom being identical. FIG. 5C is an exemplary illustration of the bottom portion of a roller door, viewed from the interior side that faces the inside of the shower area, with the top interior portion (as partially shown in FIG. 5B-3) being identical.

As illustrated in FIG. 1 and FIGS. 5A to 5C, the present invention provides one or more rolling doors 602 and 604, with a rolling door 602 or 604 of one or more rolling doors having an arched or curved horizontal or axial width 601 (FIG. 1) that is configured substantially commensurate with the arched mid-portions 424 of the header 402 and the sill 406. Further, the rolling doors of the present invention also include a vertical length 603 that is parallel along a longitudinal axis of the rolling doors that is substantially commensurate with a vertical distance between the header 402 and the sill 406. This arrangement enables the rolling doors 402 and 406 to be flush with the header 402 and sill 406 for a complete closure of the shower area, making shower enclosure 100 aesthetically pleasing and practical in terms of blocking and preventing water from splashing outside the enclosed shower area.

As further illustrated in FIGS. 5B-1 and 5C, the rolling doors 602 and 604 are comprised of a sliding panel (or rolling door) frame having a top rolling door frame member 605, a bottom rolling door frame member 607, and lateral rolling door frame members 609 that frame a closure 611 that may comprise of glass, with the frame and the closure constituting a sliding panel or rolling door 602 and 604. Both the top and bottom rolling frame members 605 and 607 include notches 614 (best illustrated in FIGS. 5B-2 and 5B-3) that house the articulating roller arm assembly 606. The notches 614 (with the exterior facing side of the notch 614 on the exterior facing surface 605A of the top rolling door frame member 605 show in FIG. 5B-2) are sufficiently separated at a notch distance 630 to prevent in-plane and out-of-plane movement of the rolling door 602 and 604 when doors are articulated (or moved along the track 806). As further best illustrated in FIG. 5B-2, the notch 614 is comprised of periphery edges 621 that accommodate a channel 616 of the articulating roller arm assembly 606 for insertion and mounting of the articulating roller arm assembly 606 onto the periphery edges 621 of the notch 614 of the top and bottom frame member 605 and 607 of the rolling door 602 and 604. As best illustrated in FIG. 5B-3, the articulating roller arm assembly 606 further includes a set of apertures 610 that are aligned with notch apertures 612 on the top and bottom rolling door frame members 605 and 607 for securely coupling the articulating roller arm assembly 606 with the frame members 605 and 607 using fasteners 613 (FIG. 5B-1).

The exemplary illustrated wheels 708 and 710 (FIG. 5B-1) of the articulating roller arm assembly 606 ride within a set of horizontally supported rails with tracks, channels or raceways 806 (shown in FIGS. 7B and 7C) of the header 402 and sill 406 of the frame 416 of the shower enclosure 100. The notches 614 in the top and bottom of the frame members 605 and 607 of the roller doors 602 and 604 in combination with the channel 616 of the articulating rolling assembly 606 allow the wheels 708 and 710 of the articulating roller arm assembly 606 to face "outside" of the shower area (towards the track 806, FIG. 5B-1) and yet, allow a vertical adjustment using the adjustment shaft 712 (described below) to take place from the "inside" (FIG. 5C) of the shower area. That is, the channel 616 is inserted within the periphery edges 621 of the notch 614 of the top and bottom frame members 605 and 607 of the rolling doors, positioning the adjustment shaft 712 at an interior side (FIG. 5C) of the enclosed shower area with first and second wheels 710 and 708 positioned at exterior side thereof (FIG. 5B-1). This arrangement facilitates quick and easy access for adjustment of the adjustment shaft by an appropriate adjustment tool and provides for an esthetically pleasing look (it creates a more esthetically pleasing look for the installed shower enclosure when viewed form the outside because as illustrated in FIGS. 1 and 5A, the articulating roller arm assembly 606 is blocked from view by the header 402 and sill 406). In addition, the adjustment shaft 712 itself is substantially not visible from outside. The position of the adjustment shaft 712 on the interior facing surface side 605B of the rolling door frame members 605 and 607 (FIG. 5C) enables easy access because there is nothing blocking access to the adjustment shafts 712 on the interior side. On the other hand, the exterior facing surface side (FIG. 5B-1) of the enclosure is closely adjacent to the header 402 and sill 406 of the support rail 806 (best illustrated in FIGS. 7B and 7C). This creates a very limited space that is defined by the short distance between the rolling door 602 and 604 and header 402 and sill 406. The axial length of a throw section 704 of a cantilever beam 702 defines this distance. This limited space would make access to and adjustment of the adjustment shaft 712 very difficult, which may accidentally damage the frame and or the header/sill support rail during the operation of adjusting the adjustment shaft 712 by an appropriate tool such as a screwdriver that may scratch the surface of the frames by accident during adjustment if for example, the screwdriver slips off the adjustment shaft 712. Accordingly, the preferred position of the adjustment shaft 712 is at the interior side of the shower area, as illustrated.

As further illustrated in FIG. 5B-1, the orientation and positioning of the outer distal wheels (or the second wheels) 708 of the articulating roller arm assemblies 606 are towards the distal ends 751 the frame members 605 and 607. These wheel orientations facilitate in preventing in-plane (twisting or rotational) movement of the rolling doors 602 and 604 to provide a stable articulation and further, enable the rolling doors 602 and 604 to move completely into the straight sections 420 and 422 of the shower enclosure 100 for a wider opening for egress/ingress from the shower area.

Figure 6A:
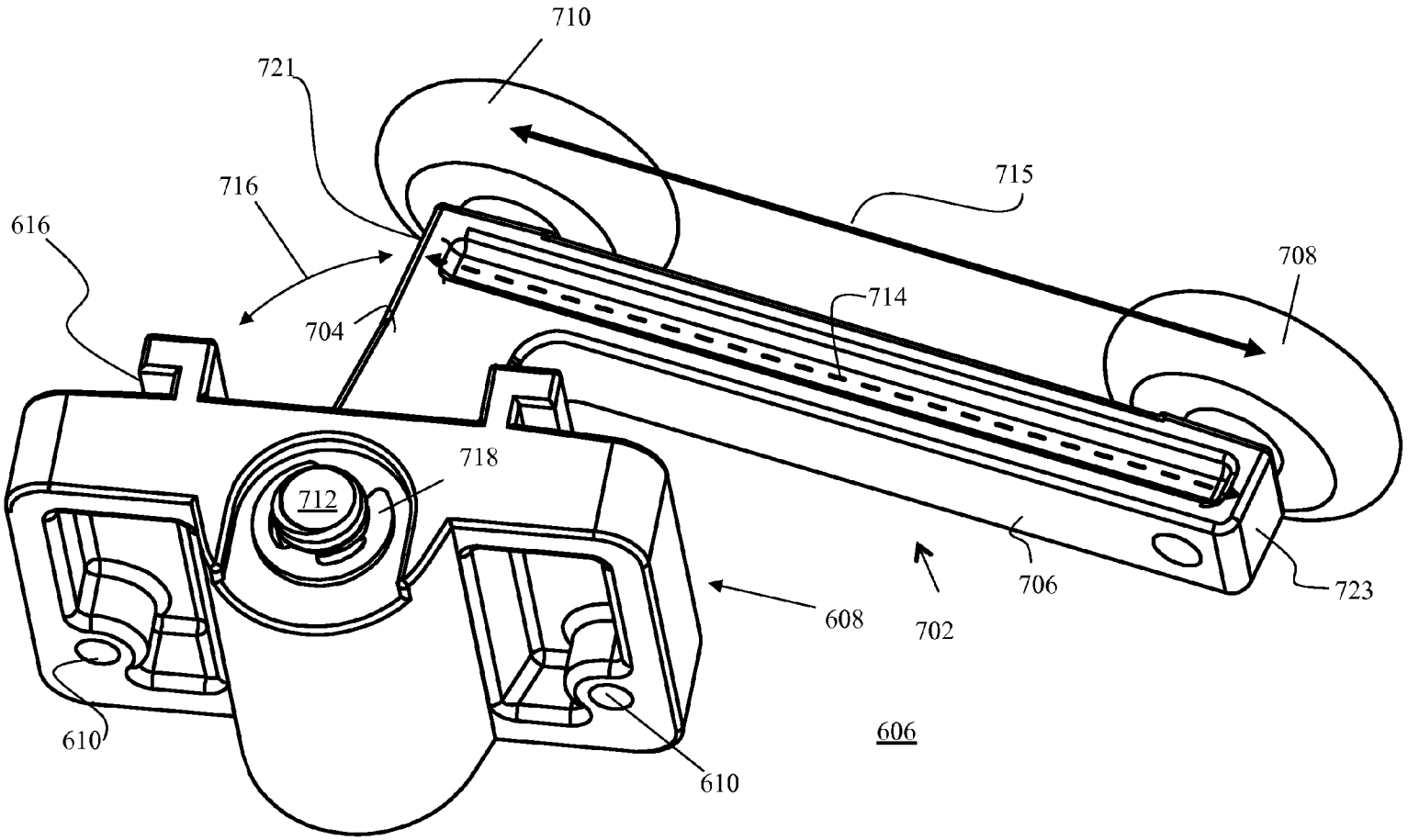
FIGS. 6A to 6G are exemplary illustrations of the various views of an articulating roller arm assembly in accordance with the present invention.
Figure 6B:
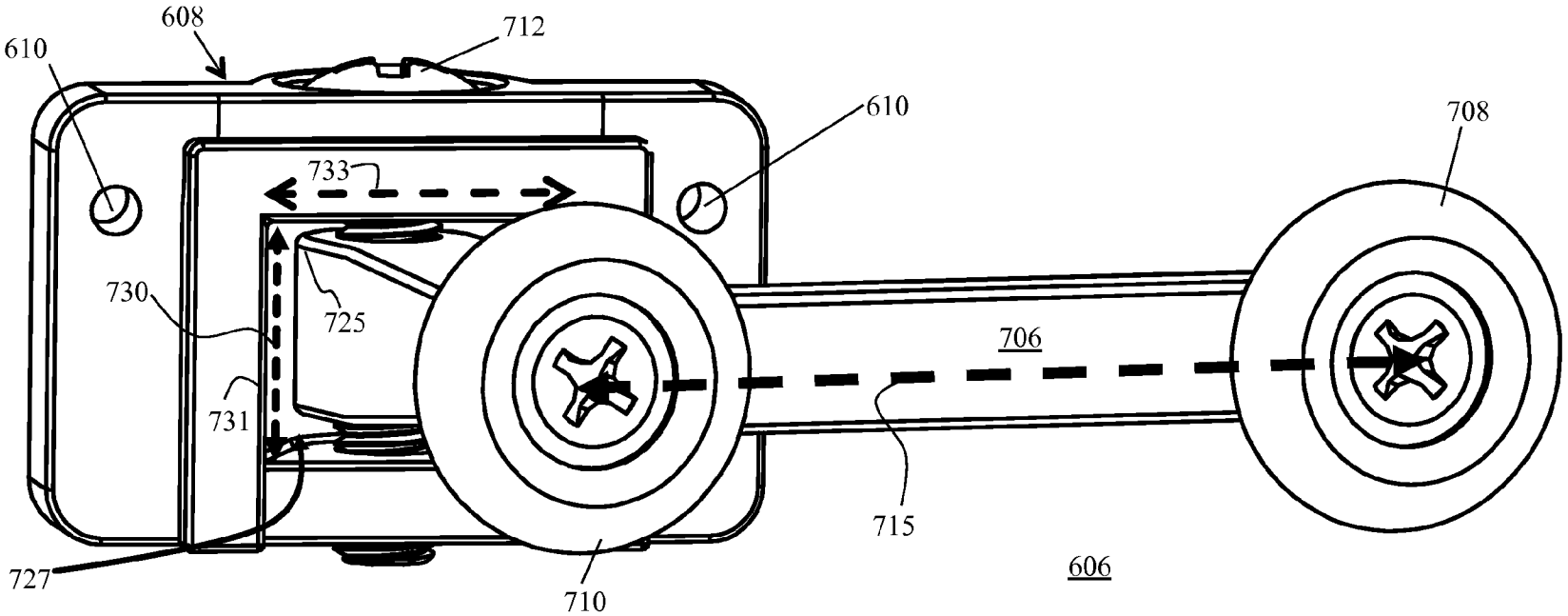
Figure 6C:
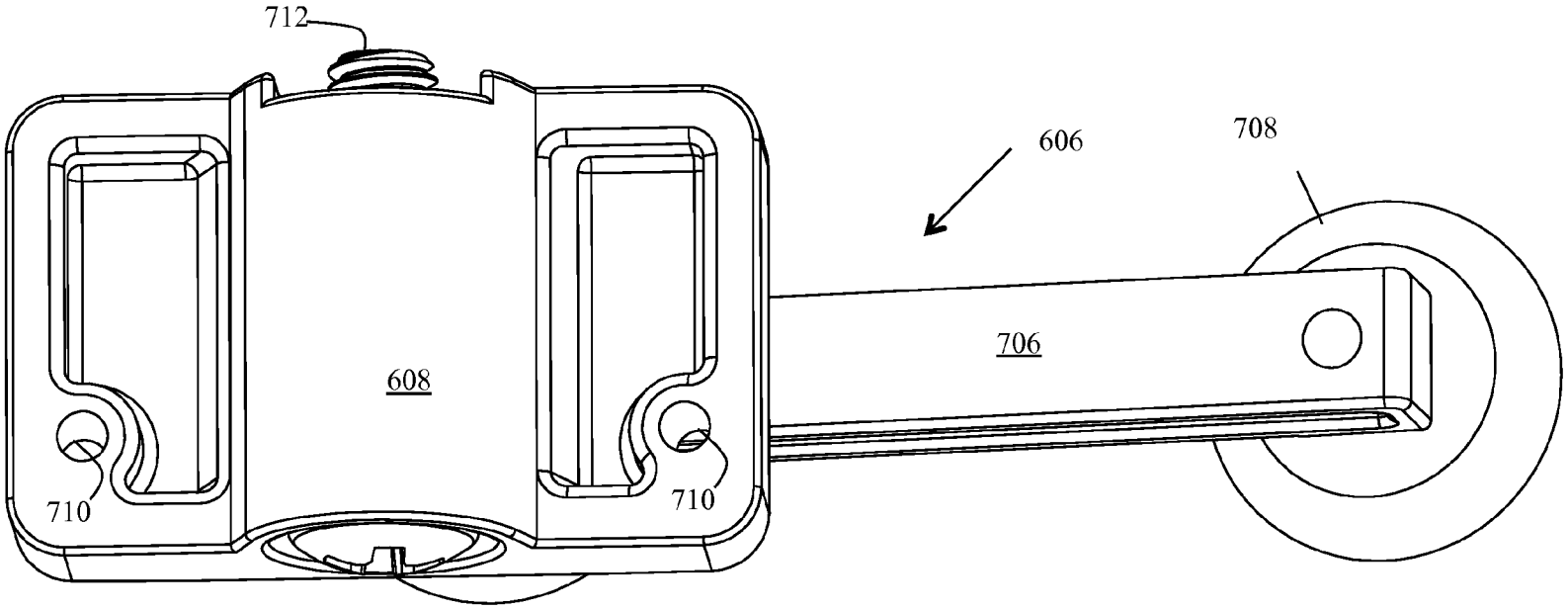
Figure 6E:
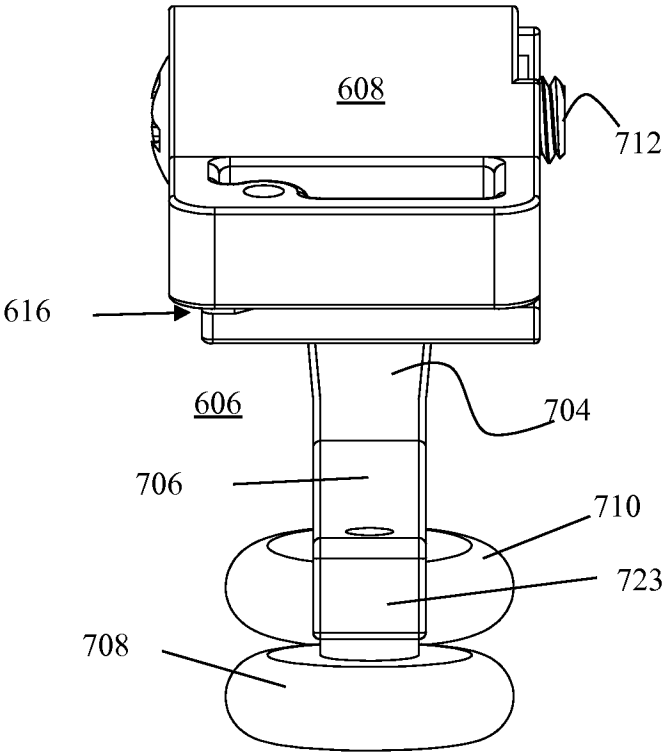
Figure 6D:
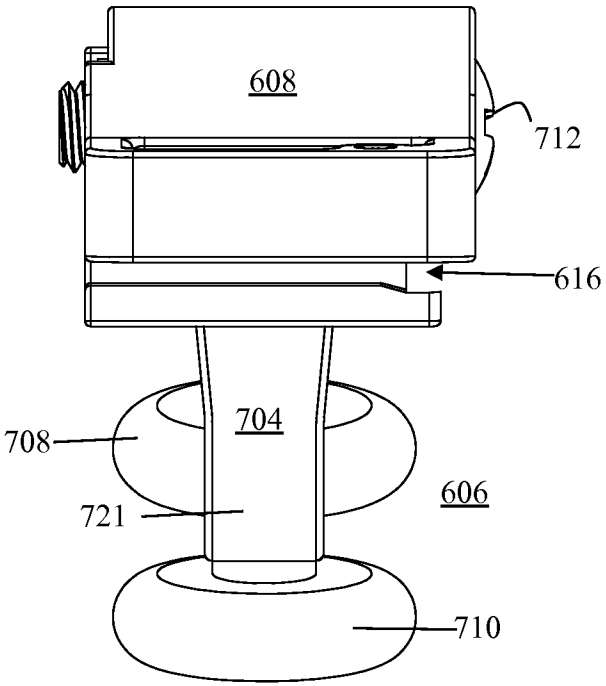
Figure 6G:
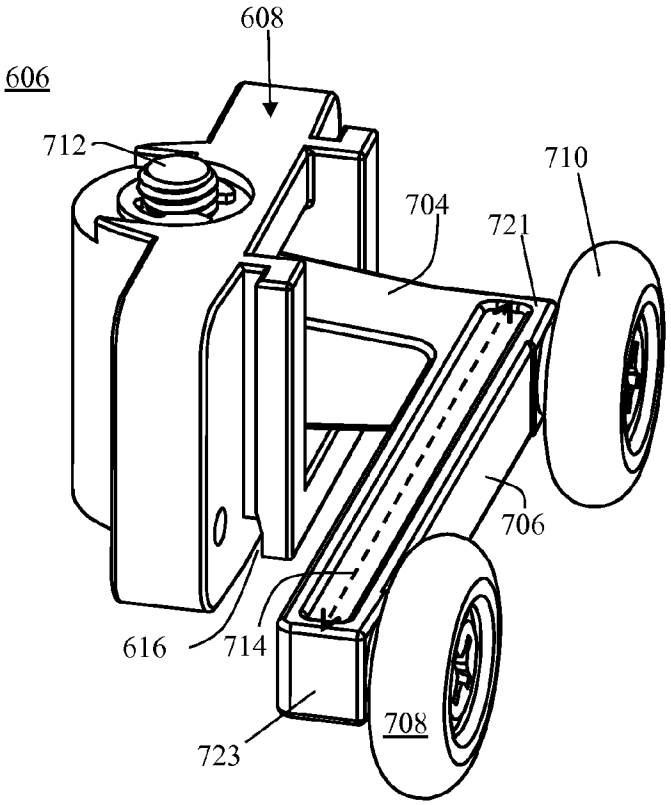
Figure 6F:
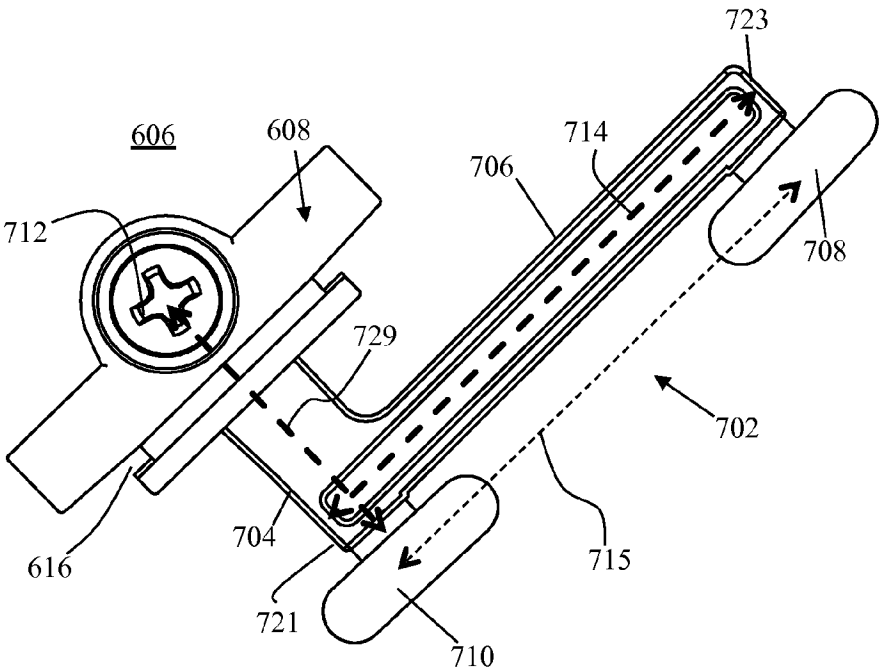
Figure 6H:
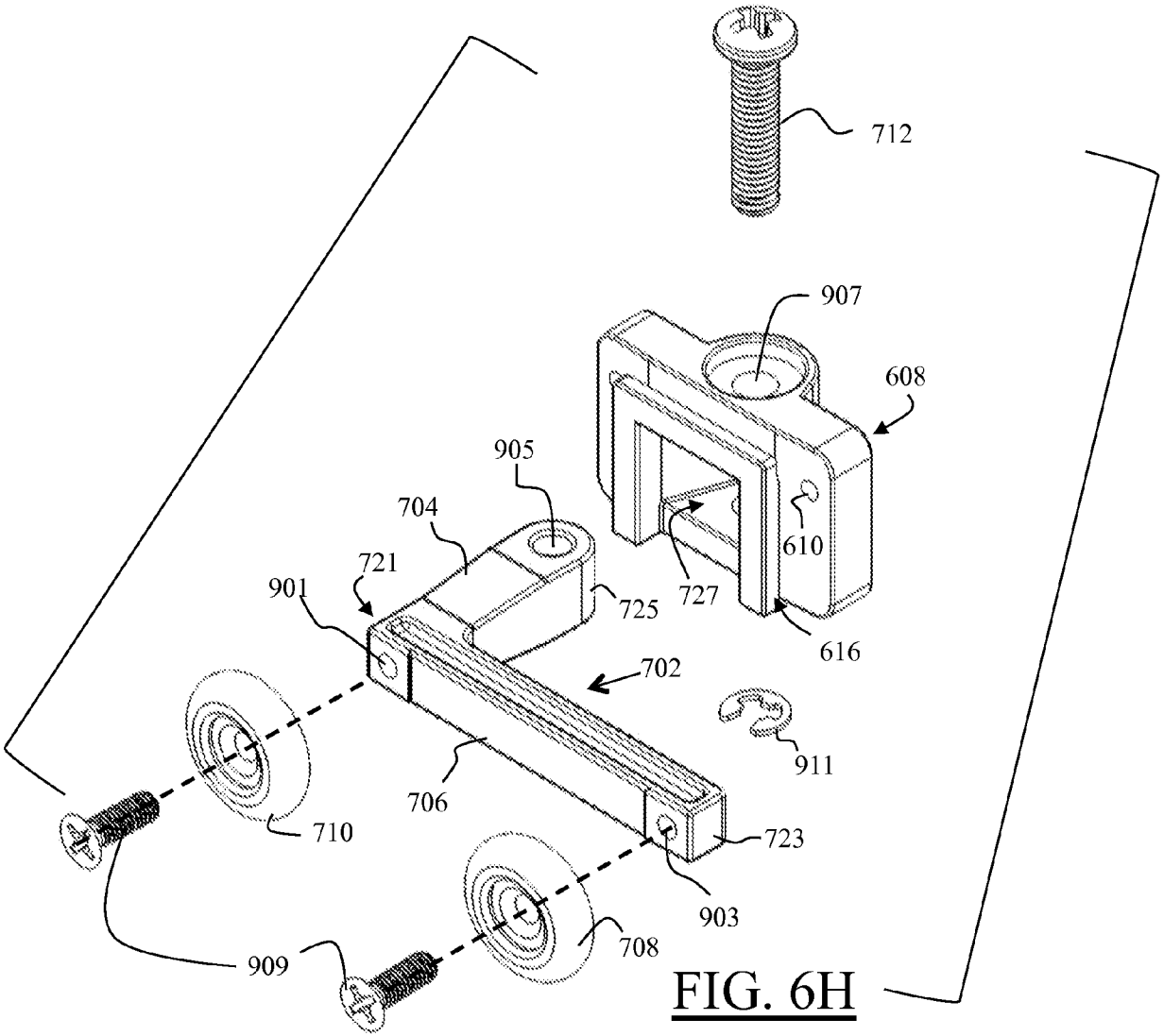
FIG. 6H exemplarily illustrates a disassembled, exploded view of the articulating roller arm assembly illustrated in FIGS. 6A to 6G in accordance with the present invention.

FIGS. 6A to 6G are exemplary illustrations of the various views of a fully assembled articulating roller arm assembly in accordance with the present invention, with FIG. 6H exemplarily illustrating a disassembled, exploded view of the same with the separated parts to show the relationship and order of assembly of the articulating roller arm assembly in accordance with the present invention. As illustrated, the articulating roller assembly 606 of the present invention is preferably comprised of a single piece cantilever beam 702 having a throw section 704 and a span section 706, with the throw section 704 oriented substantially transverse the span section 706, and the span section 706 having a length 714 that is substantially longer than the length 729 (FIG. 6F) of the throw section 704. A first distal end of the span section 706 and a distal end of the throw section define a bend at the general area indicated by reference 721. The articulating roller assembly 606 further includes a first wheel 710 that is coupled with a first distal end of the span section 706 (at 721), and a second wheel 708 that is coupled with a second distal end 723 of the span section 706.

The formed bend at 721 of the single integral piece cantilever beam 702 constitutes a corner-elbow section, forming a substantially L-shaped beam with the throw section 704 and the span section 706 as the extremities of the L-shaped beam. It should be noted that the formed bend at 721 may also constitute a rounded corner-elbow section, forming a substantially rounded L-shaped beam 702 with the throw section 704 and the span section 706 as the extremities of the rounded L-shaped beam. Therefore, the formed elbow of the beam 702 at area 721 does not have to be at a 90-degree angle. Given that the cantilever beam 702 moves in relation to the roller support 608 in a reciprocating path indicated by the arrow 716, the movement along path 716 will compensate to a certain degree for the variations in the selected angle or curvature of the elbow.

As further illustrated, the throw section 704 includes a bulkier connecting distal end 725 (FIG. 6B) with a connecting aperture 905 (FIG. 6H) that enables the connecting distal end 725 to pivotally couple within a cavity 727 of the roller support 608 with the adjustment shaft 712. The pivotal or rotatable coupling of the connecting distal end 725 of the throw section 704 with the adjustment shaft 712 enables the cantilever beam 702 to rotate and swing along the indicated reciprocating path 716 (about the longitudinal axis of the shaft 712) within the cavity 727 of the roller support 608 to enable articulation of the articulating roller arm assembly 606 along both the curved 424 and straight 420 and 422 portions of the header 402 and sill 406. That is, as the articulating roller arm assembly 606 moves along the straight/curved sections of track 806, the cantilever beam 702 is forced by the curved/straight track sections to steer or maneuver by pivoting along the reciprocating path 716. The roller support 608 includes inner cavity walls 731 that delimit the movement of the single piece cantilever beam 702 in the reciprocating path 716. It should be noted that the throw section 704 does not contact the inner cavity walls 731 throughout its reciprocating path 716 along the header/sill railing when fully assembled and installed. In other words, the cavity 727 has sufficient width 733 such that the beam 702 does not contact the sidewalls 731 of the cavity 727 when the beam swings along path 716 during a normal use of an installed door. The travel distance of the reciprocating path 716 of the beam 702 is closely associated with the arc, roundness or amount of curvature of the support rail header and sill frame 416. That is, sufficient room for travel distance along the path 716 is provided so that the rolling door 602 and 604 does not jamb during opening or closing operations.

Both the throw section 704 of the articulating roller arm assembly 606 and the adjustment shaft 712 are designed to delimit the movement of the rolling doors 602 and 604 in relation to the track 806 of the header/sill 402/406 of the frame 416. The turn or rotation of the adjustment shaft 712 within a pair of adjustment shaft apertures 907 (FIG. 6H) of the roller support 608 enables vertical adjustment of the single piece cantilever beam 702 along a vertical reciprocating path 730 in relation to the roller support 608. This adjustment, in turn, adjusts the vertical distance between the single piece cantilever beam 702 coupled with the top frame member 605 and the single piece cantilever beam 702 coupled with the bottom frame member 607 of the rolling door 602 and 604. The adjustment accounts for minor variations from install to install. That is, the adjustability helps tighten the articulating roller arm assemblies 606 (at the top and the bottom frame members 605 and 607) against the track 806 of the frame 416 on which the wheels 710 and 708 of the articulating roller arm assembly 606 ride. Accordingly, the adjustment compensates, amongst others (and without limitations), for material size tolerance variations in the vertical height of the door assemblies and variations in the top and bottom rails 806 of the header/sill 402/406 of the frame 416. Therefore, after the installation of the articulating roller arm assembly 606 onto the track 806 of the frame 416, the adjustment shaft 712 may be turned or rotated to tightened the grip of the rollers onto the track by pulling-in the beam 702 of the top frame member 605 towards the beam 702 of the bottom frame member 607 to reduce the vertical distance 603 between the articulating roller arm assembly 606 of the top and bottom frame members 605 and 607. This adjustment enables a rolling door 602 and 604 to fit snuggly onto the tracks 806 of the frame 416 for a smooth roll, and help prevent in plane and out of plane movement of the door. Additionally, this adjustment effectively interlocks the rolling doors 602/604 with the header/sill 402/406 via the wheels 710 and 708, insuring the rolling doors 602/604 maintain full connection with header/sill 402/406 during their respective reciprocating moves.

As indicated above, the articulating roller assembly 606 that are installed onto the top and bottom frame members 605 and 607 of the doors 602 and 604 bear the entire weight of the doors. As a result, bending moments and shear stress are incurred in both the throw section 704 of the roller arm and the adjustment shaft 712 for each articulating roller assembly 606 installed. Accordingly, the adjustment shaft 712 also functions to support 608 the weight of the door 602 and 604, and is securely interconnected with the roller support by the lock ring 911 (FIG. 6H). In addition, the connecting distal end 725 of the throw section 704 is made bulkier for grater structural integrity in terms of increased structural strength to resist incurred bending moments and shear stresses.

As further illustrated and described above, the roller support 608 further includes the channel 616 for insertion and mounting of the roller support 608 onto the periphery edges 621 of the notches 614 of the frames 605 and 607 of the rolling door 602 and 604. As further stated above, the set of apertures 610 on the roller support 608 are used for securely fastening the mounted roller support 608 to the frame members 605 and 607 of the enclosure 611.

The articulating roller arm assembly 606 further includes the pair of wheels 708 and 710, with the first wheel 710 of the pair of wheels coupled with the proximal end 721 of the span section 706, with area 721 defining the general elbow formed from an intersection of the span section 706 and the throw section 704. The articulating roller arm assembly 606 also includes the second wheel 708 of the pair of wheels coupled at the second distal end 723 of the span section 706. As illustrated, the first and second wheels 710 and 708 are coupled with the respective first and second distal ends 721 and 723 by a pair of wheel axels 909 (FIG. 6H) secured to respective first and second axel holes 901 and 903 on the span section 706.

Figure 6I:
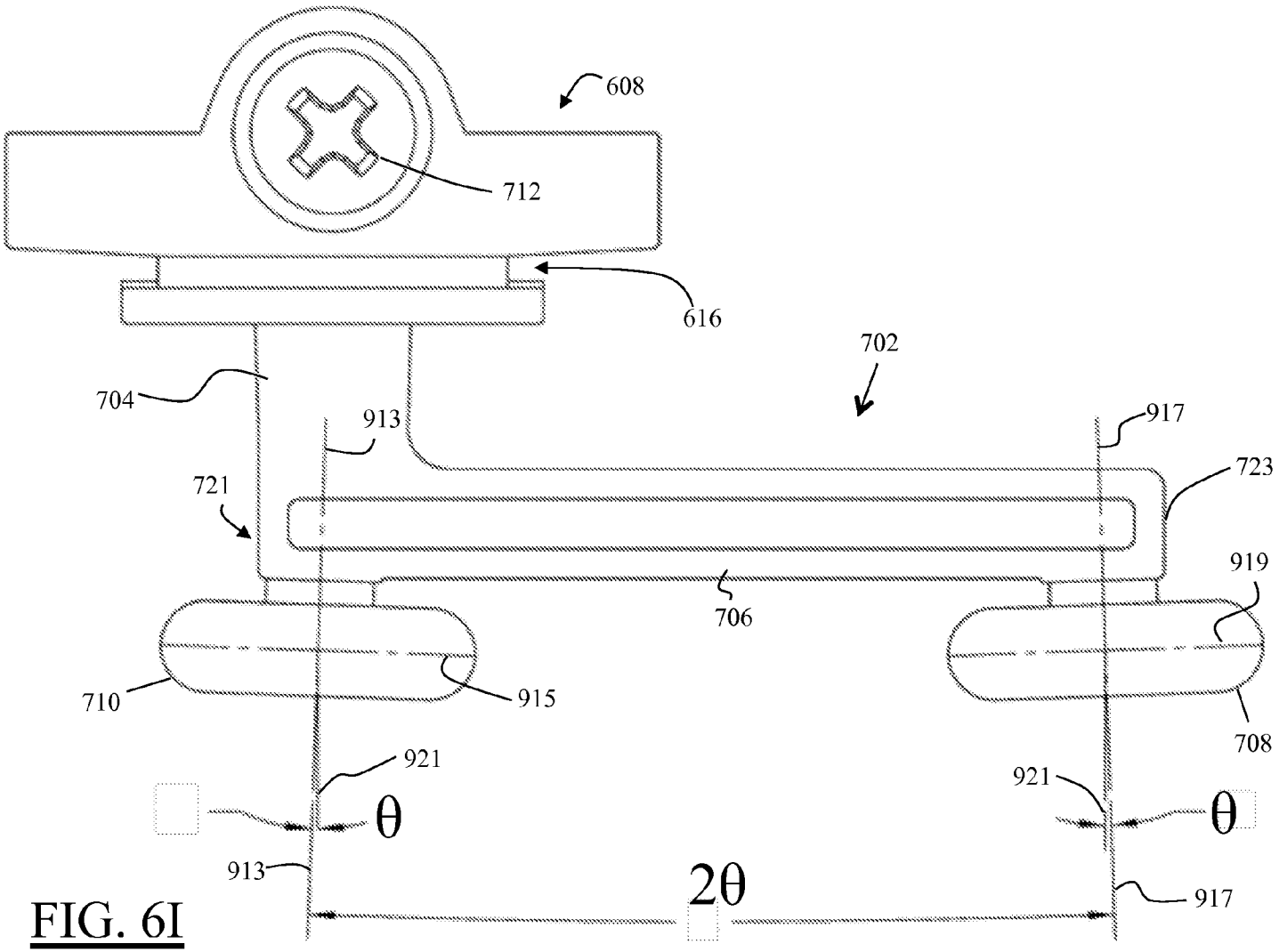
FIGS. 6I to 6K exemplarily illustrate the details of the wheels connections with the span section of the articulating roller arm assembly in accordance with the present invention.
Figure 6J:
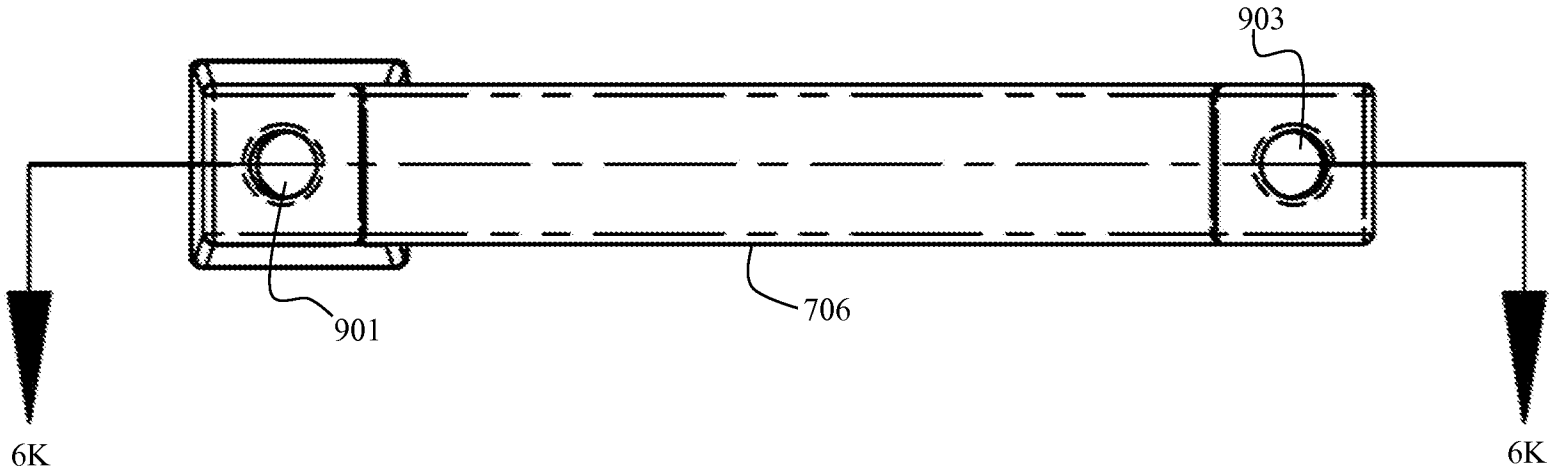
Figure 6K:
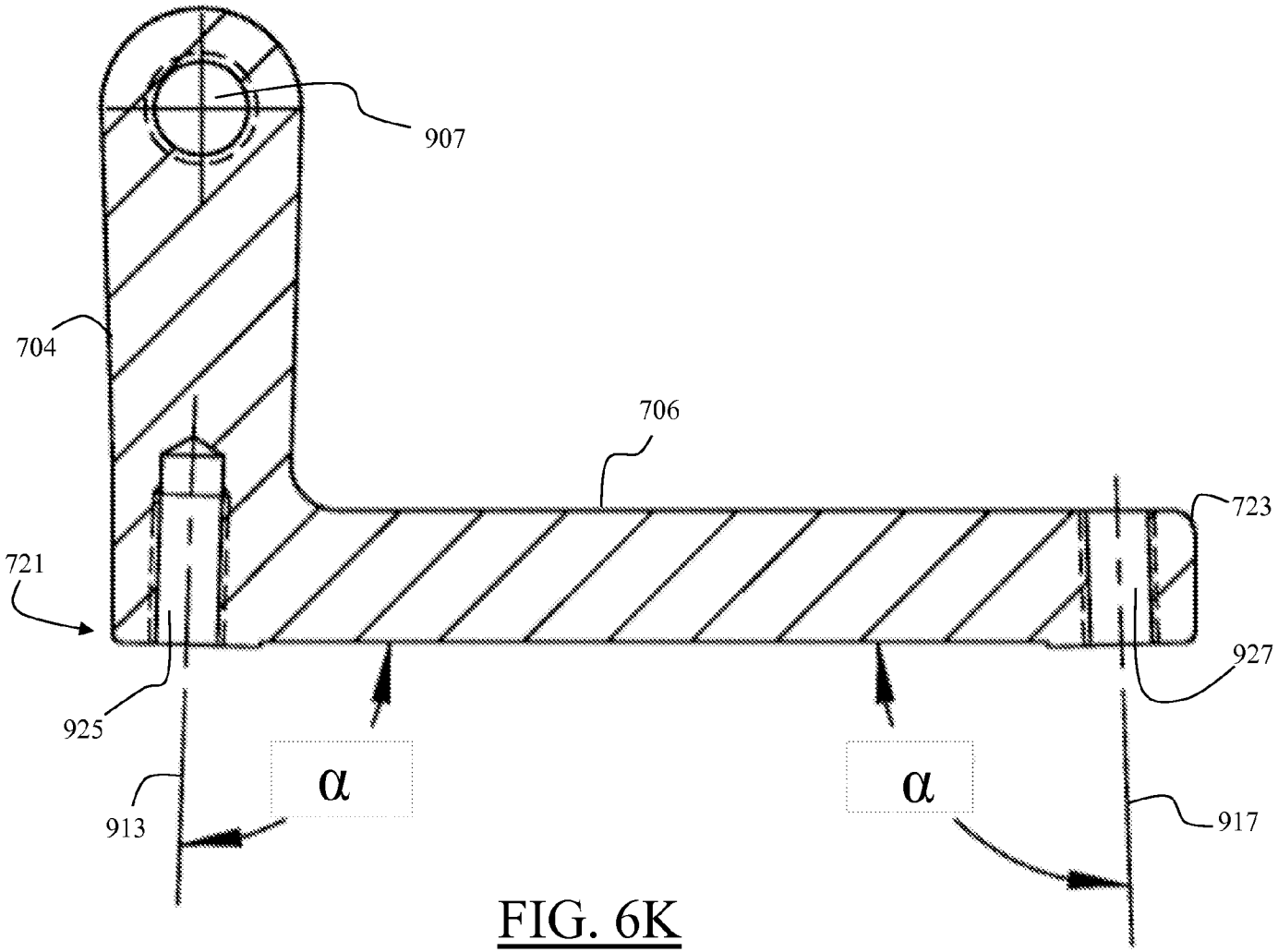

FIGS. 6I to 6K exemplarily illustrate the details of the wheel connections with the span section of the articulating roller arm assembly in accordance with the present invention. As illustrated, the first and second wheels 710 and 708 of the articulating roller arm assembly 606 are not aligned and in fact, the respective rotational planes 915 and 919 of the wheels 710 and 708 that pass through the body of the wheels are not inline. That is, their rotational planes 915 and 919 (the planes within which the wheels rotate) are misaligned at an angle $2\theta$ (i.e., $\theta+\theta=2\theta$) in relation to one another. A non-limiting example of the misalignment angle $\theta$ from the perpendicular 921 is about 2°. As best illustrated in FIG. 6K, which is a sectional view taken from the plane indicated by the broken line 6K-6K in FIG. 6J, a first and second axel cavity 925 and 927 of the span section 706 that accommodate the respective wheel axels 909 have respective central longitudinal axis 913 and 917 that are at an angle $\alpha$ in relation to the longitudinal axis 714 of the span section 706, rather than perpendicular therewith (at an angle of 90°) as illustrated by the perpendicularly oriented broken lines 921 (FIG. 6I), making the total misalignment at a non-limiting exemplary angle $\alpha$ of about 92°. This arrangement misaligns the wheels 710 and 708 and situates their respective rotational planes 915 and 919 at a non-parallel relationship, perpendicular to the respective central longitudinal axis 913 and 917 of the respective first and second axel cavity 925 and 927.

Therefore, the set of wheels 710 and 708 of the articulating roller arm assembly 606 are not perfectly inline, but are misaligned. Typically, the ideal rolling motion along a linear (i.e., straight) path may be defined as one where the rotational plane of a wheel coincides (and is aligned) with its linear translational motion or travel direction of the path. For the two-wheel system of the articulating roller arm assembly 606, typically, the ideal rolling motion along a linear (i.e., straight) path may be defined as one where the rotational planes of both wheels coincide (and are aligned) with the linear translational path. That is, to achieve the ideal rolling motion along a linear (i.e., straight) path, the rotational planes 915 and 919 of the wheels 710 and 708 must coincide (and be aligned) with each other and coincide (and be aligned) with the travel direction of the path on which the wheels travel. Simply stated, to achieve an ideal linear rolling motion, the wheels 710 and 708 must be a set of perfectly inline wheels that move along a straight path.

Likewise, typically, the ideal rolling motion along a curved path may be defined as one where the rotational plane of a wheel is aligned to be exactly tangent to the curve on which the wheel travel. In other words, the plane of rotation of the wheel touches the curved path at a point but does not intersect the curve at that point. For a two-wheel system of the articulating roller arm assembly 606, typically, the ideal rolling motion along a curved path may be defined as one where the rotational planes of both of the wheels are aligned to be exactly tangent to the curve on which the wheels travel. That is, to achieve the ideal rolling motion along a curved path, the first rotational plane 915 of the first wheel 710 must be aligned so that it is exactly tangent to the curve (i.e., the pane 915 touches the curved path at a point on the curve but does not intersect the curve at that point). In addition, the second rotational plane 919 of the second wheel 708 must also be aligned so that it is exactly tangent to the curve (i.e., the second plane 919 touches the curved path at a point on the curve but does not intersect the curve at that point). Accordingly, both planes 915 and 919 of the wheels 710 and 708 must be aligned so that each is exactly tangent to the curved path, with both respectively touching the curved path at their respective tangent points but do not intersect the curve at their respective tangent points. Therefore, for a two-wheel system, there would be two separate tangent points (one for each wheel), with a distance between the tangents defined by the distance 715 between the wheels. Accordingly, for a two-wheel system on a curved path, the rotational planes 915 and 919 will be misaligned in relation to one another to achieve the tangential requirements for the ideal rolling motion along a curved path. The amount of misalignment will vary depending on the separation distance 715 between the wheels and the angle of the curvature of the curved path. It is important to note that the greater the distance (in this exemplary instance, separation distance 715) between a set of wheels 710 and 708 that travel/roll together on a curve, the greater the angle of misalignment between the wheels in order for the wheels 710 and 708 to remain orientated exactly tangent to the curve in which they are traveling so to result in the ideal rolling motion. Accordingly, the alignment of the wheels 915 and 919 is closely associated with the travel path, and will vary commensurately with shape (straight or curved) of the path and the distance 715 between the wheels.

In the event a wheel is not appropriately (or ideally) aligned commensurate with an associated path in which it travels, the wheel will be forced to move in a direction substantially perpendicular to its direction of travel/rolling, causing the wheel to slide (or skid). In general, skidding is an undesirable motion of a wheel because it results in added friction. It is important to note that the greater the amount of angular misalignment of a wheel with the path it is traveling (moving away from the ideal), the greater amount of perpendicular skid experienced by the wheel, thus the greater amount of friction that occurs while moving the misaligned wheel along its path.

For a set of substantially inline wheels that travel/roll in the same direction, any misalignment between the two wheels will cause the wheels to work against each other resulting in the wheels to force each other to move in a direction perpendicular to their respective direction of travel/rolling. In other words, any misalignment between the two wheels causes both wheels to share the collective misalignment of the wheels with the path. It is important to note that the greater the total angle of misalignment between the two wheels, the greater amount of perpendicular skid experienced by both wheels, resulting in a proportional increase in friction.

Figure 7A:
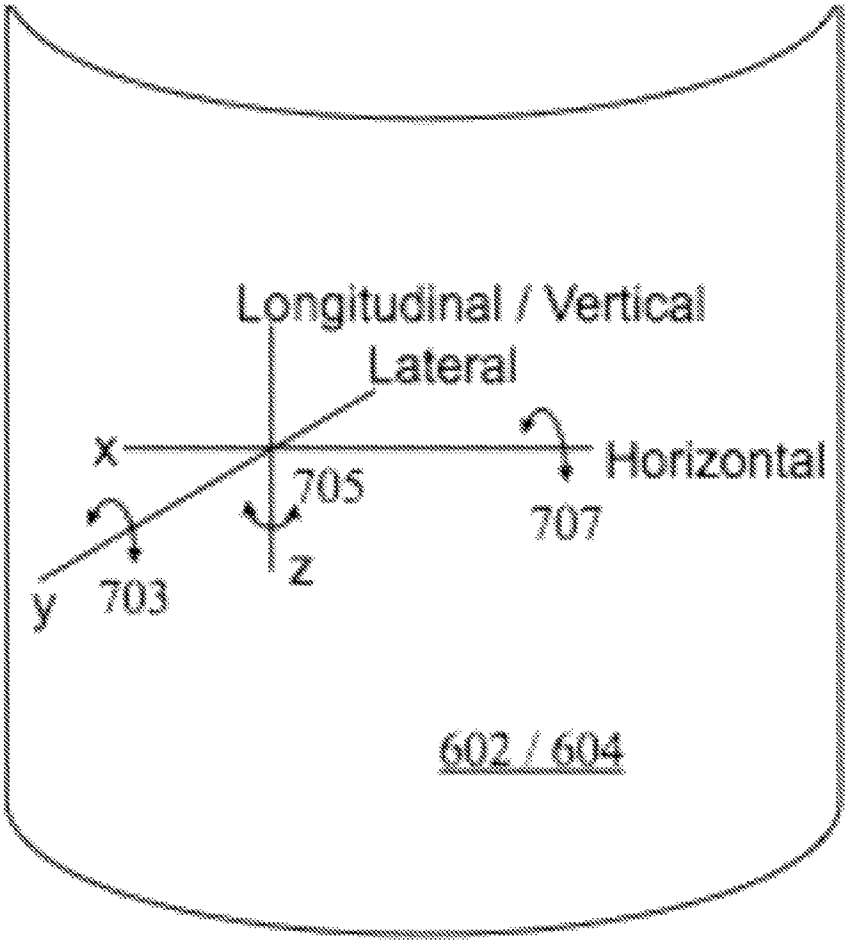
FIG. 7A is an exemplary illustration of various potential in-plane and out-of-plane movements of the rolling doors in accordance with the present invention.
Figure 7B:
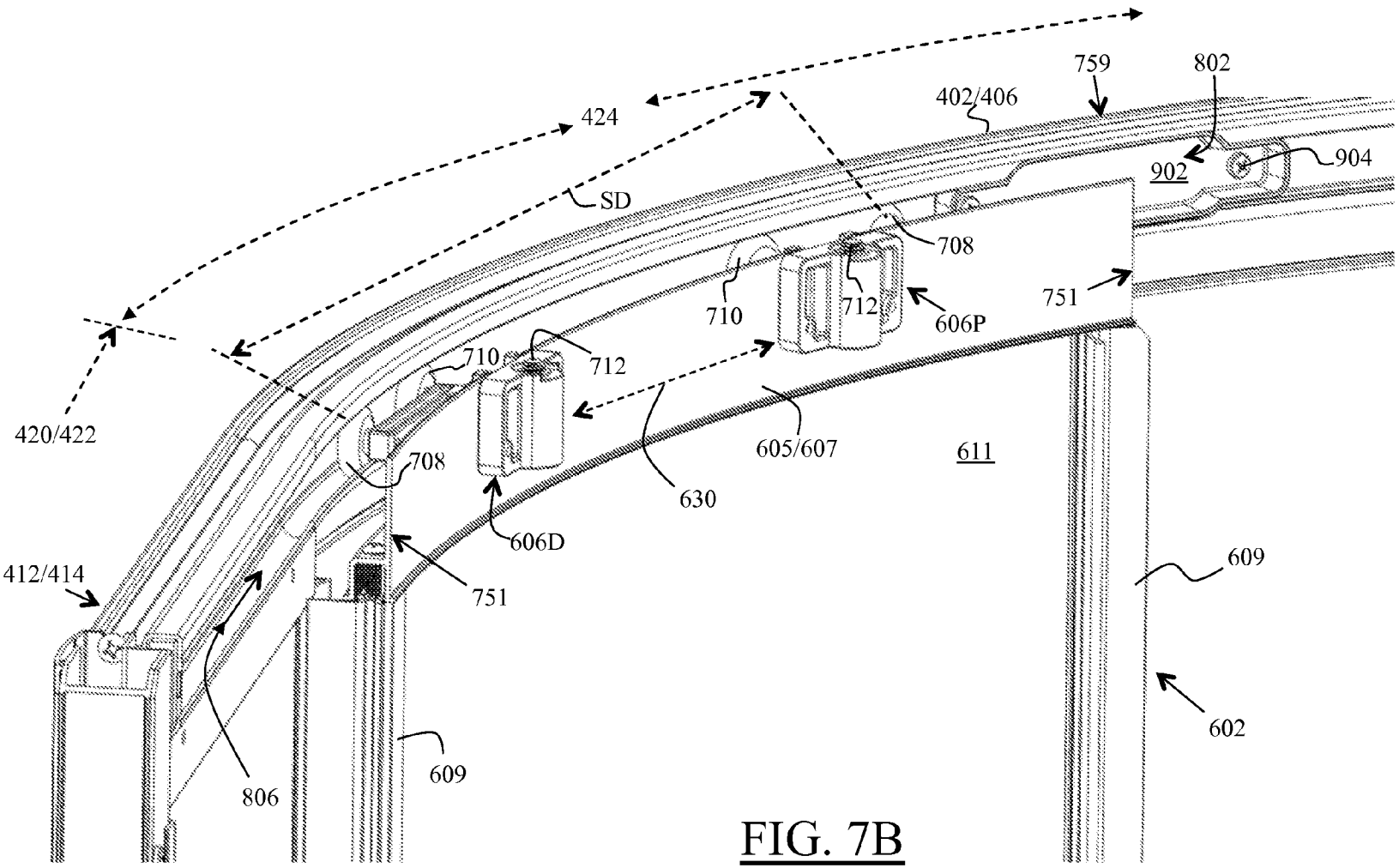
FIGS. 7B to 7D are exemplary illustrations of a cooperative relationships between various components of a rolling door as they are articulated along a track of the frame of the shower enclosure of FIG. 1 in accordance with the present invention.
Figure 7C:
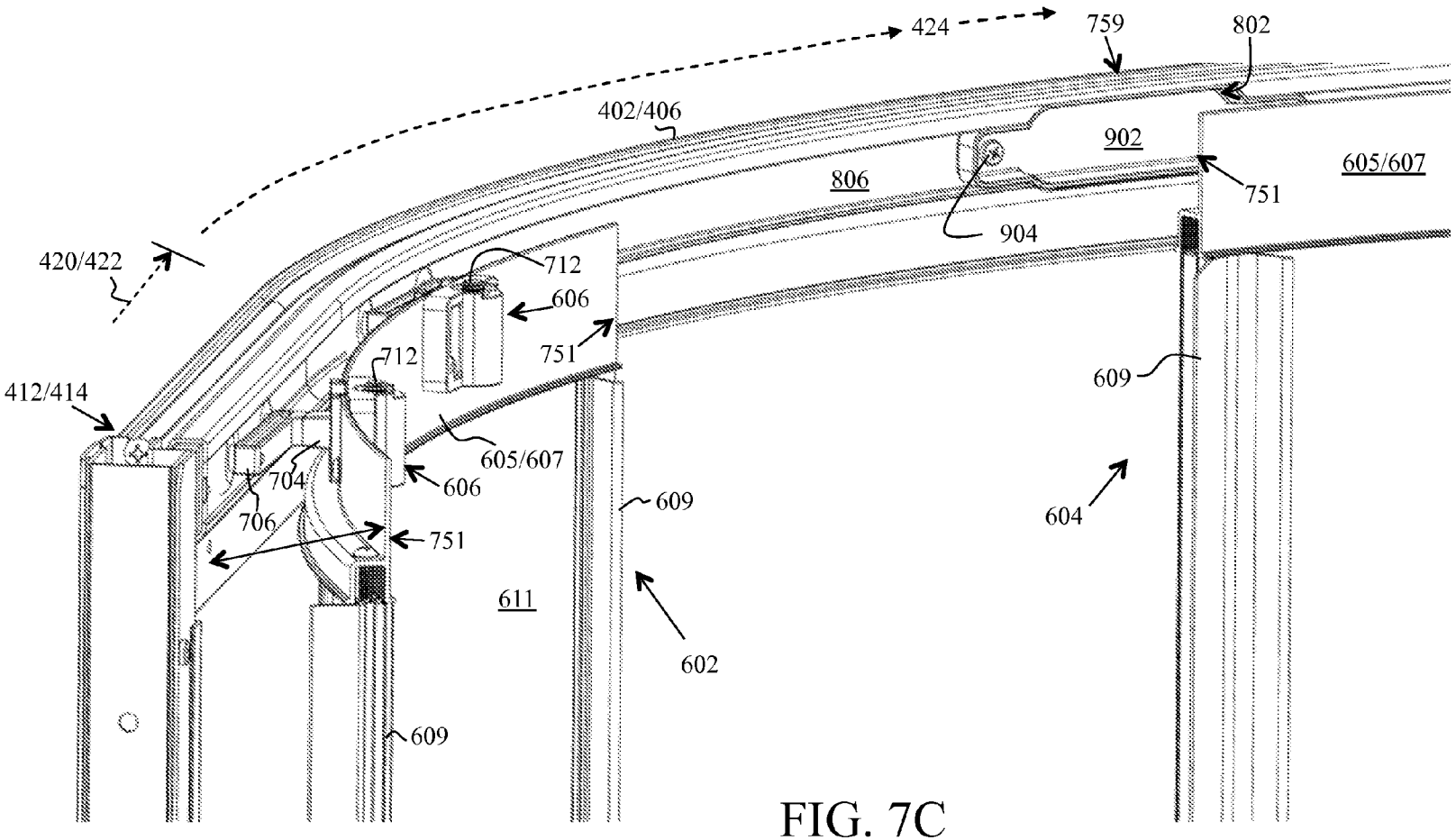
Figure 7D:
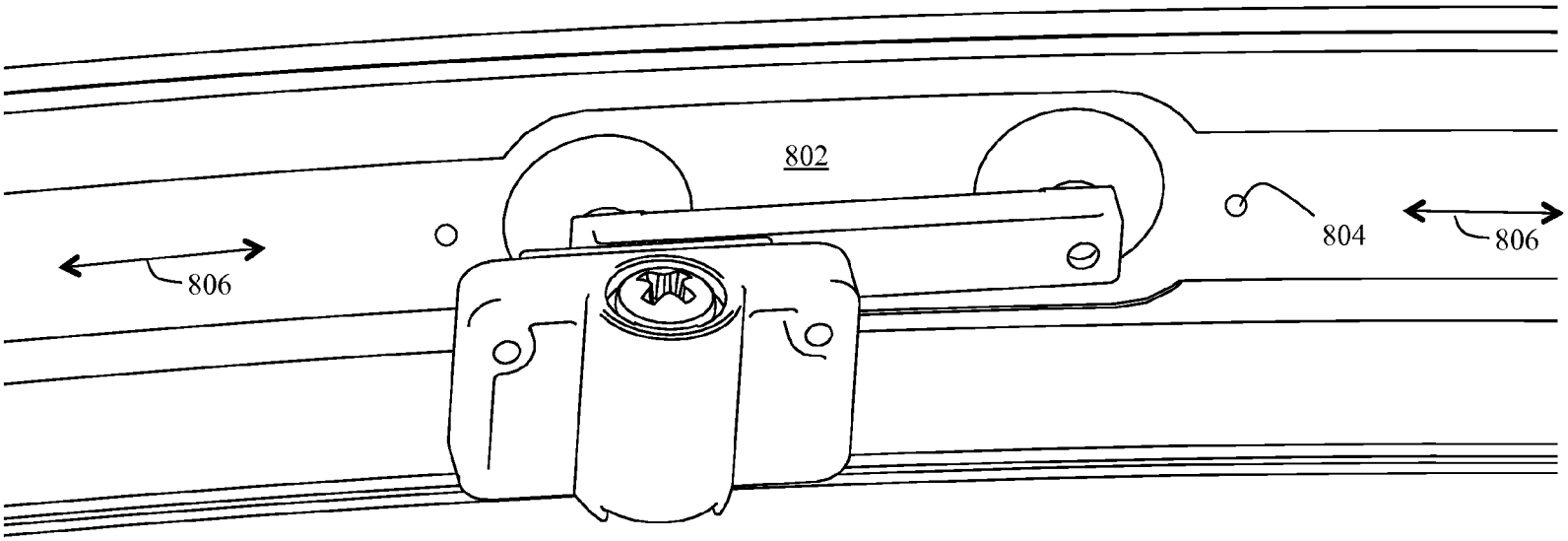

FIG. 7A is an exemplary illustration of various potential in-plane and out-of-plane movements of the rolling doors in accordance with the present invention. FIGS. 7B to 7D are exemplary illustrations of the cooperative relationships between various components of a rolling door (including the wheel misalignments described above) as they are articulated along a track of the frame of the shower enclosure of FIG. 1 for maximum opening for ingress/egress of the shower area and smooth articulation of the doors in accordance with the present invention.

Referring to FIGS. 7B to 7D, the present invention provides a track 806 on the header/sill 402/406 that has both a curved section 424 and straight sections 420/422. Accordingly, the set of wheels 710 and 708 of the cantilever beam 702 of the articulating roller arm assembly 606P (proximal) and 606D (distal) must travel along both the curved and straight sections of track 806. Therefore, the wheel 710 and 708 cannot have the above ideal rolling motions (curved or straight). Thus, the present invention provides an alignment of the wheels that is a compromise between perfectly inline alignment (for straight sections of the track) and exactly tangent to the curve alignment (for the curved section of the track). This results in minimized friction that is roughly equal in both the straight and curved sections of the track during the operation of the door, while maintaining maximum ingress/egress from the shower enclosure area, and stable door operations.

As illustrated in FIG. 7A with respect to rolling door 602 and 604, the phrase "in plane" is defined as the plane that passes through the body of the rolling door 602 and 604. That is, as illustrated, in this exemplary instance, the plane passing through the rolling door is the XZ-plane. The in-plane movement may be a rotational movement of the rolling door 602 and 604 about the Y-axis in the reciprocating path indicated by arrow 703 and/or a translational movement along the XZ-plane, which is the move of the door vertically, up or down parallel along the Z-axis or laterally along the X-axis or both, with all movement being within the XZ-plane. The out-of-plane movement is defined as a translational movement along the Y-axis, including rotational movements about the X-axis defined by the arrow 707 and/or the Z-axis defined by the indicated arrow 705. Translational movement may be defined as a straight movement.

Referring back to FIGS. 7B to 7D, in general, the cantilever beam 702 has associated with it lateral, torsional, and vertical bending modes due to the force of the weight of the doors thereon during operation, which mostly occur at the throw section 704 of the beam 702. The throw section 704 of the beam 702 has the longitudinal axis 729 that maintains a fixed perpendicular distance between the track (or raceway) 806 of the header/sill 402/406 of the frame 416 and the rolling door 602 and 604. In general, the throw section 704 stabilizes out-of-plane motions of the rolling door 602 and 604 due to exerted bending moment (and or shear stress) thereof on the throw section 704 (in particular at connecting distal end 725 with the adjustment shaft 712), and delimits in-plane motions of the rolling door 602 and 604. Therefore, extending the length of the throw section 704 would generate a greater moment arm at its connection point 725 with the adjustment shaft 712, placing greater stress thereon the connection point. That is, the entire weight of the door would become more pronounced due to the increased length or distance between the frame 416 from which the door 602 and 604 is hung and the rolling door 602 and 604 itself, with the said length or distance defined by the axial length 729 of the throw section.

The span section 706 supports the set of wheels 710 and 708 that are coupled at respective first and second distal ends 721 and 723 that are separated longitudinally along the axial length 714 of the span section 706 (with separation distance 715). The longitudinal separation 715 between wheels 710 and 708 and the total separation distance 630 between two articulating roller arm assemblies 606P (proximal) and 606D (distal), and in particular, separation SD between 606P and 606D respective second distal wheels 708 on a rolling door provides for a greater span (or a "wider base") upon which a weight of the rolling doors 602 and 604 is spread or distributed, which facilitates reductions in the in-plane motions of the shower door 602 and 604 while the wheels 710 and 708 roll within the raceway 806 of the header/sill 402/406 of the frame 416, resulting in increased stability of motion. In general, the distal end wheels 708 of both the proximal and distal articulating roller arm assemblies 606P and 606D mostly facilitate to prevent in-plane rotational movements of the rolling door, and their proximal end wheels 710 mostly prevent out-of-plane movements of the rolling door. In addition, the extended axial length 714 of the span section 706 (from the bend area 721) and in particular, the position of the wheel 708 at distal end 723 for each unit 606 enables for maximum reach of the wheels (in particular wheels 708) to the very distal ends 412 and 414 of the frame 416 for maximum articulation of the rolling door 602 and 604 for an increased ingress/egress from the shower area. Accordingly, the span section 706 facilitates in stabilizing the rolling door 602 and 604 in respect of the in-plane and out-of-plane motions of the doors during their movement, and enables for the maximum reach of the wheels (in particular wheels 708) to the very distal ends 412 and 414 of the frame 416 for maximum articulation of the rolling door.

It would be preferred to have the second distal end wheels 708 of both the proximal and distal articulating roller arms 606P and 606D positioned as far away as possible from the apex center of the curved doors, with the apex defined at the center width axis 759 of the rolling doors 602 and 406, which extends lengthwise along the door central longitudinal axis. That is, the closer the distal wheels 708 of the proximal and distal articulating roller arms 606P and 606D to the respective distal ends 751 of the frame members 605/607, the greater the stability of the rolling doors due to the greater increase in the separation distance SD between the wheels 708 of articulating roller arm assemblies 606P and 606D, which would further reduce in-plane motion. The arrangement would also provide for a greater travel distance for the rolling doors to the very distal ends 412 and 414 of the frame 416 for maximum articulation of the rolling door.

Therefore, the present invention provides the orientation and positioning of the outer distal wheels (or the second wheels) 708 of the articulating roller arm assemblies 606P and 606D towards the distal ends 751 of the frame members 605 and 607, away from the apex 759. These wheel orientations facilitate in preventing the in-plane (twisting or rotational) movement of the rolling doors 602 and 604 to provide a stable articulation and further, enable the rolling doors 602 and 604 to move completely into the straight sections 420 and 422 of the shower enclosure 100, almost to the very distal ends 412 and 414, for a wider opening for egress/ingress from the shower area. If the wheels are shifted closer to the apex 759, then the separation distance SD between respective wheels of both of the installed articulating roller arm assembly 606P and 606D on the frame members of the doors would reduce, which, in turn, would reduce the articulation and stability of the doors.

It should be noted that increasing the longitudinal axis 714 of the span section 706 may increase the distance 715 between the wheels 710 and 708 to place the second distal wheels 708 further from the apex center 759. However, doing so would increase the desired angle of misalignment between the wheels in order for the wheels to remain orientated exactly tangent to the curved section in which they are traveling. Because the alignment of the wheels 710 and 708 attached to the cantilever beam 702 cannot be designed for an "ideal" rolling motion in both straight and curved sections of tracks 806 of the header/sill 402/406, any compromise between perfectly inline orientation with each other and orientated exactly tangent to the curved section of tracks in which they are required to travel would result in an undesirable increase in the incurred friction present while operating the doors of the shower enclosure in both the straight and curved sections of tracks. Simply stated, if the wheel distance 715 is made longer, then the wheel orientations must be further aligned to compensate for the tangential requirements of the curved track. However, this greater misalignment to enable the rotational planes 915 and 919 of the wheels 710 and 708 to align tangent to the track curve would mean greater misalignment of the wheels 710 and 708 with respect to each other, which would cause greater friction when the wheels 710 and 708 travel through the straight sections 420/422 of the track 708.

As further illustrated in FIG. 7D, the support rail or track 806 includes an installation notch 802, which is an area within the track 806 where portions of the track or rail 806 of the header 402 and sill 406 of the frame 416 is removed to allow the wheels of the articulating roller arm assembly 606 to enter the track 806. The installation notch 802 is generally positioned in the center of the header 402 and the sill 406. After insertion of the articulating roller arm assembly 606 via the installation notch 802, a stopper 902 is installed and secured in the installation notch 802 area with fasteners 904 inserted into the illustrated holes 804, with the stopper functioning as a stop for the articulating roller arm assembly 606 in the closed operating position.

Figure 8A:
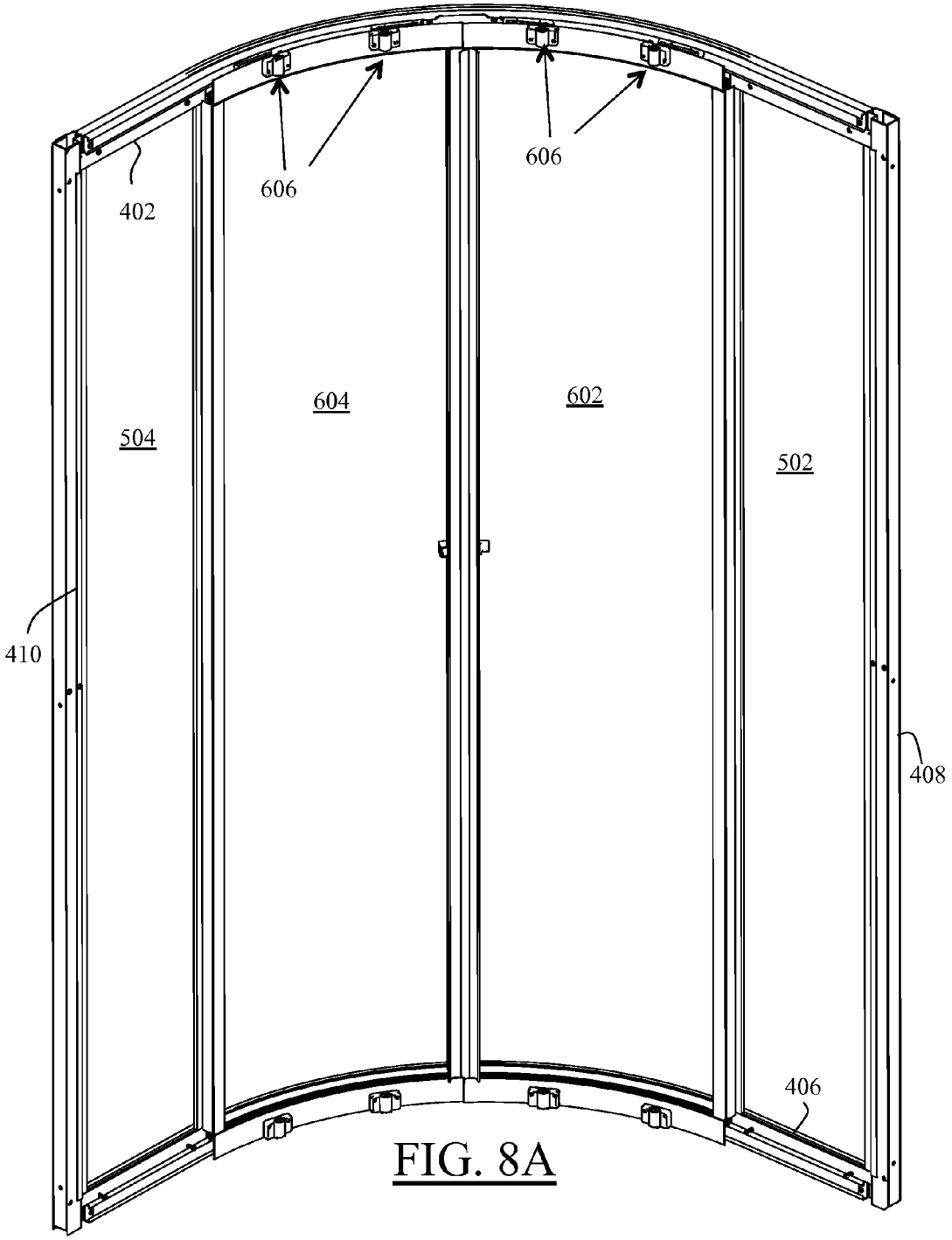
FIGS. 8A to 8C are exemplary illustrations of a fully assembled shower enclosure of FIG. 1, viewed from within the enclosed shower area in accordance with the present invention.
Figure 8B:
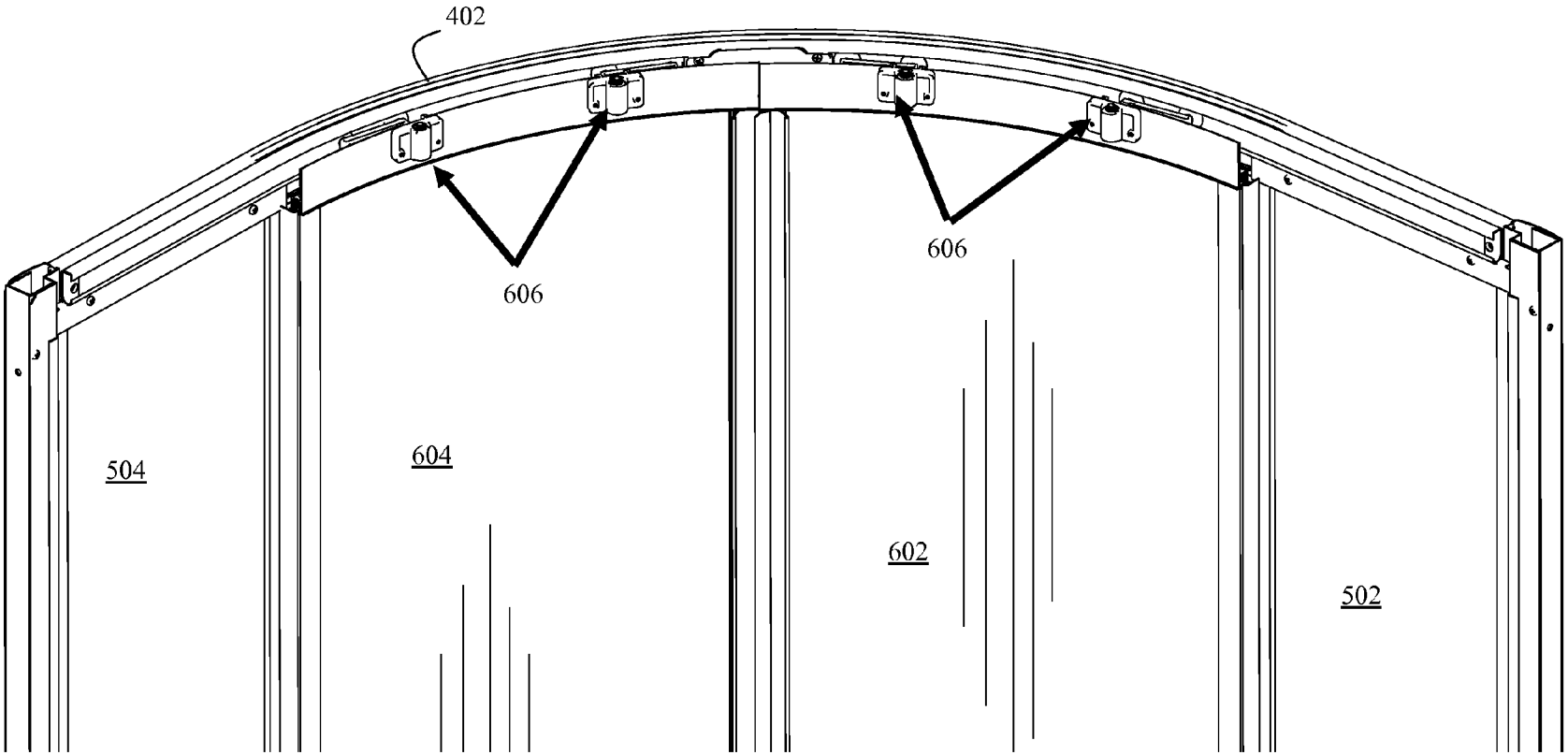
Figure 8C:
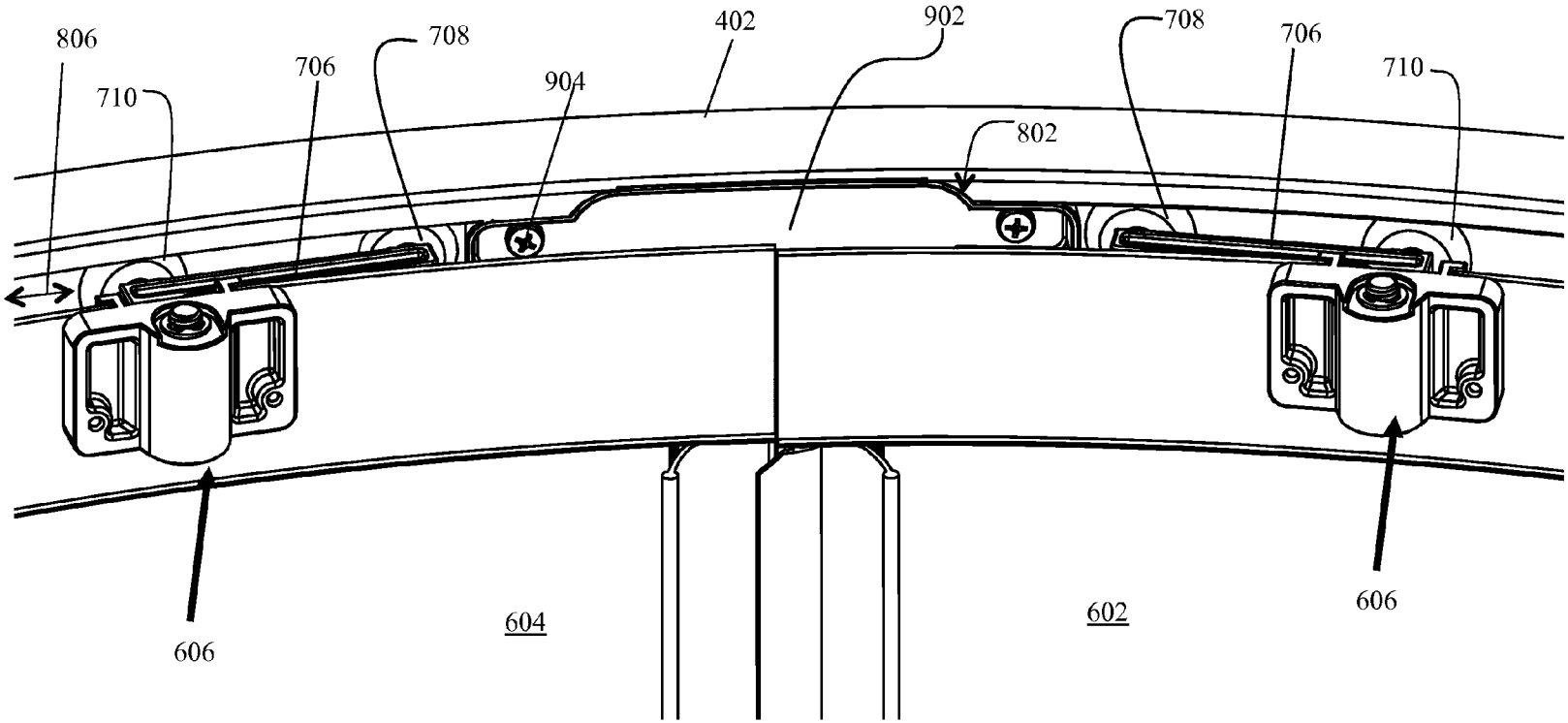
Figure 9A:
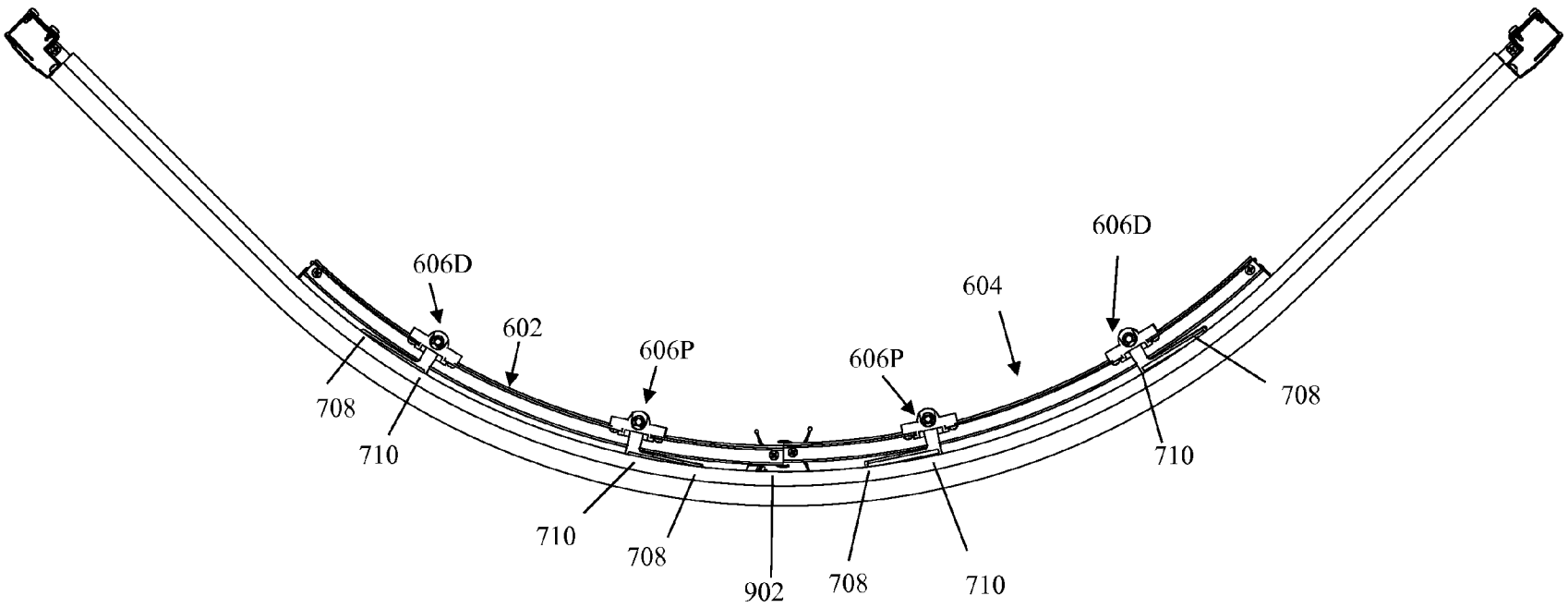
FIGS. 9A to 9D are exemplary top view illustration of the shower enclosure of FIG. 1, progressively illustrating the opening of rolling doors in accordance with the present invention.
Figure 9B:
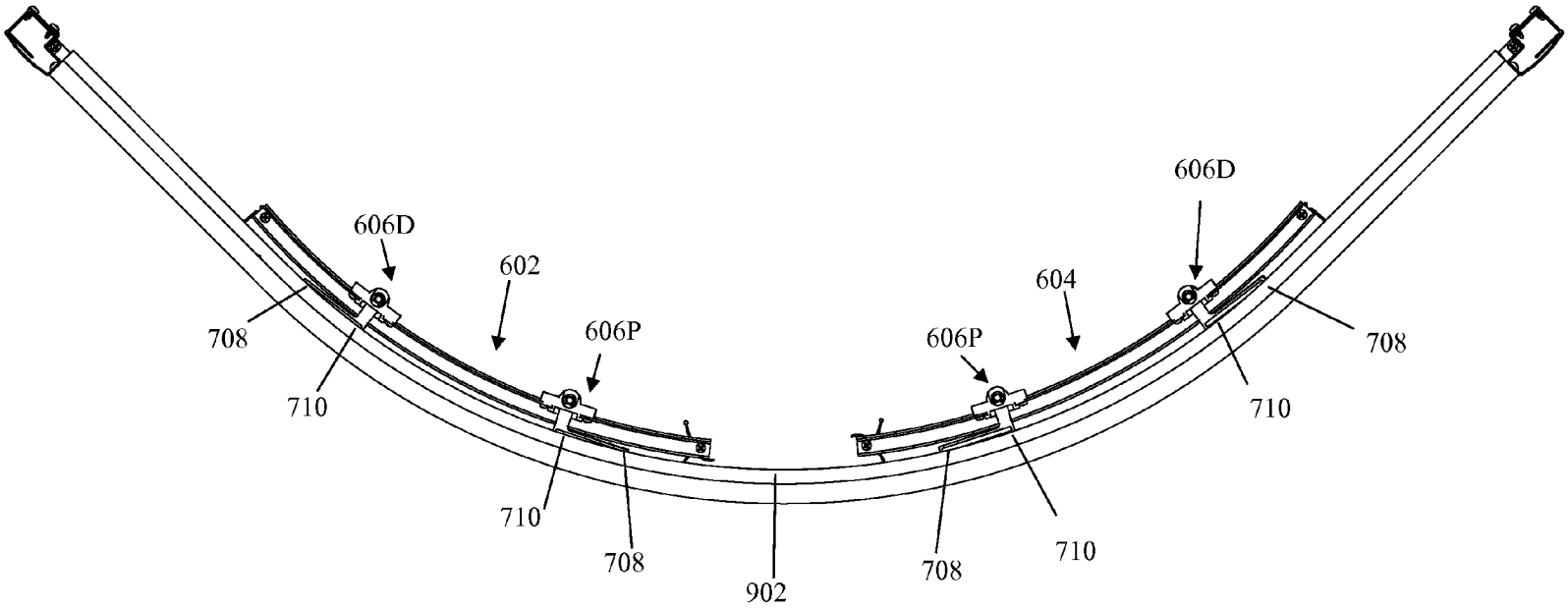
Figure 9C:
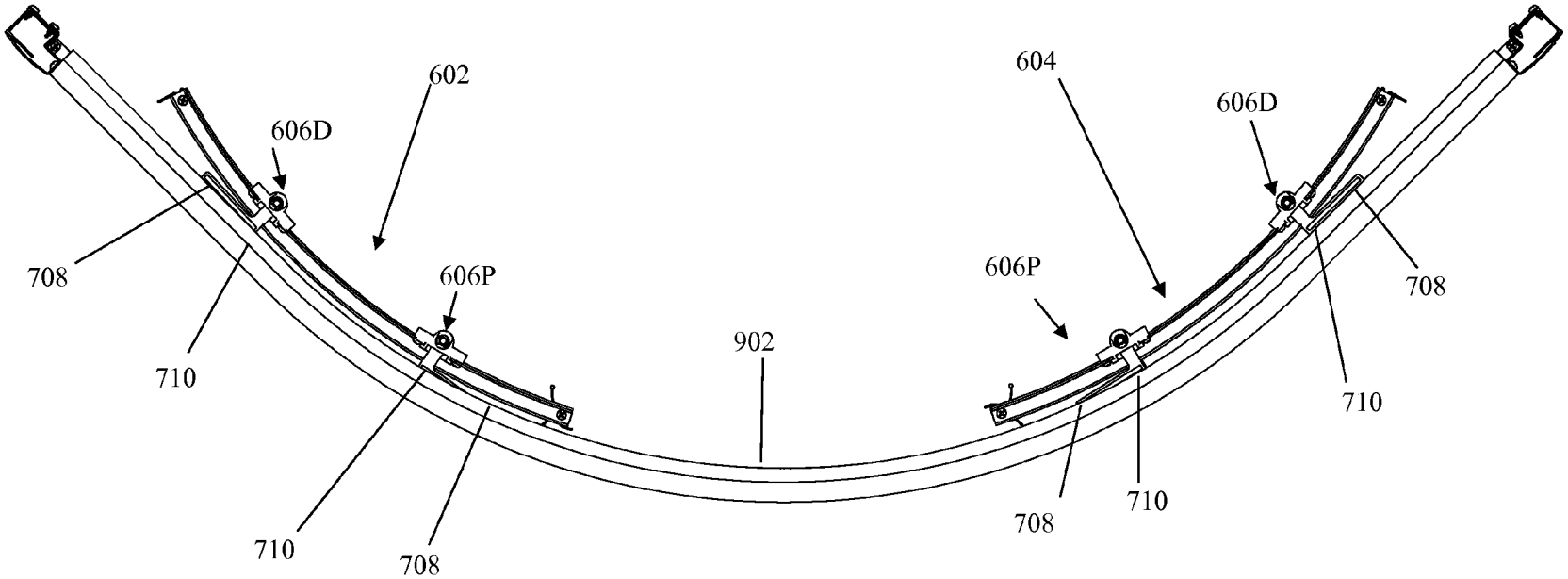
Figure 9D:
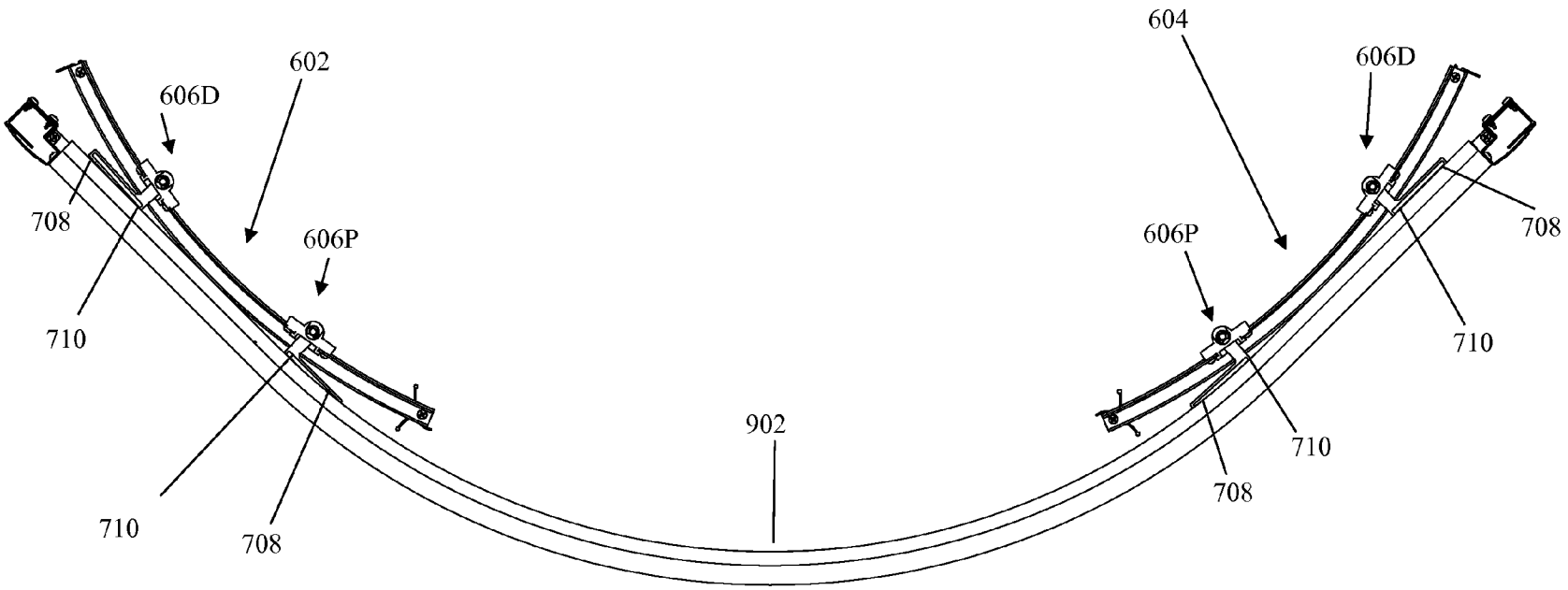

FIGS. 8A to 8C are exemplary illustrations of a fully assembled shower enclosure of FIG. 1, viewed from within the enclosed shower area in accordance with the present invention. As illustrate, after installing both of the rolling doors 602 and 604, the stopper 902 (FIG. 9C) is installed and secured in the installation notch 802 area with fasteners 904 inserted into holes 804, which functions as a stop for the rollers. This way, for example, if both doors 602 and 604 are at an open position, and a user moves to close only one of the doors (e.g., 602) to its closed position (while the other door 604 is still at its open position), the stopper 902 will stop the closing rolling door 602 at the center of the header/sill, preventing the moving door 602 to pass center stop. As further illustrated, the second distal end wheels 708 of the articulating roller arm assemblies 606 contact the stopper (bumper) 902 in closed position.

FIGS. 9A to 9D progressively illustrate the opening of the rolling doors of the present invention. As illustrated, the wheels 710 and 708 of the articulating roller arm assembly 606 of the rolling doors 602 and 604 ride along raceway 806 of the header 402 and sill 406 (both the curved 424 and straight sections 420 and 422) of the frame 416. As the rolling doors progressively move towards the straight sections 420 and 422 of the shower enclosure, the wheels positions and orientations, and the movement of the beam along path enable smooth transition for the rolling doors along their reciprocating path within the raceway 806. The orientation and positioning of the outer distal wheels 708 of the distal articulating roller arm assemblies 606D are towards the distal ends 412 and 414 of the frame 416, and the orientation and positioning of the outer wheels 708 of the proximal articulating roller arm assemblies 606P are towards the center of the frame 416. These wheel orientations facilitate in preventing the in-plane (twisting or rotational) movement of the rolling doors, enable the rolling doors to move completely into the straight/flat sections 420 and 422, and 424 of the shower enclosure, which enable wider opening for egress/ingress from the shower enclosure. In particular, the distal end wheels 708 of the distal articulating roller arm assemblies 606D and the distal end wheels 708 of the proximal articulating roller arm assemblies 606P face opposite one another to provide the large separation distance SD that enables the weight of the rolling door to be distributed along a longer or wider span between the distal wheels 708 of the distal and proximal articulating roller arm assemblies 606D and 606P, greatly reducing in-plane motion of the doors during operation and thereby improving stability. Additionally, the distal wheels 708 of the distal articulating roller arm assemblies 606D provide a greater reach-span to the very distal ends 412 and 414 of the header 402 and sill 406 for maximum articulation of the rolling doors 602 and 604 to maximize ingress/egress of the shower area.

Although the invention has been described in considerable detail in language specific to structural features and or method acts, it is to be understood that the invention defined in the appended claims is not necessarily limited to the specific features or acts described. Rather, the specific features and acts are disclosed as preferred forms of implementing the claimed invention. Stated otherwise, it is to be understood that the phraseology and terminology employed herein, as well as the abstract, are for the purpose of description and should not be regarded as limiting. Therefore, while exemplary illustrative embodiments of the invention have been described, numerous variations and alternative embodiments will occur to those skilled in the art. For example, silicone is applied on both the inside and outside of the enclosure wherever metal parts meet the pan and the surround. Such variations and alternate embodiments are contemplated, and can be made without departing from the spirit and scope of the invention.

It should further be noted that throughout the entire disclosure, the labels such as left, right, front, back, top, bottom, forward, reverse, clockwise, counter clockwise, up, down, or other similar terms such as upper, lower, aft, fore, vertical, horizontal, oblique, proximal, distal, parallel, perpendicular, transverse, longitudinal, etc. have been used for convenience purposes only and are not intended to imply any particular fixed direction or orientation. Instead, they are used to reflect relative locations and/or directions/orientations between various portions of an object.

In addition, reference to "first," "second," "third," and etc. members throughout the disclosure (and in particular, claims) is not used to show a serial or numerical limitation but instead is used to distinguish or identify the various members of the group.

In addition, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of," "act of," "operation of," or "operational act of" in the claims herein is not intended to invoke the provisions of 35 U.S.C. 112, Paragraph 6.

What is claimed is:

1. An articulating roller assembly, comprising:

a cantilever beam, having:

a throw section and a span section;

the throw section is oriented transverse the span section with a first distal end of the span section and a distal end of the throw section forming a bend of the cantilever beam where the span section commences at the distal end of the throw section and extends in one direction, with the span section having a length that is longer than the throw section;

the throw section includes a pivot portion that enables the cantilever beam to rotate along a reciprocating path when the throw section rotates during operation of the cantilever beam.

2. The articulating roller assembly as set forth in claim 1, further comprising:

a first wheel that is coupled with the first distal end of the span section has a first rotational plane and a second wheel that is coupled with a second distal end of the span section has a second rotational plane, where the first rotational plane is at an angle in relation with the second rotational plane.

3. The articulating roller assembly as set forth in claim 1, wherein:

the formed bend constitutes an corner-elbow section of the cantilever beam, forming a generally L-shaped beam with the span section and the throw section as the extremities of the L-shaped beam.

4. The articulating roller assembly as set forth in claim 1, wherein:

the formed bend constitutes a rounded corner-elbow section of the cantilever beam, forming a generally rounded L-shaped beam with the span section and the throw section as the extremities of the rounded L-shaped beam.

5. The articulating roller assembly as set forth in claim 1, wherein:

the pivot portion of the throw section includes a connecting distal end that pivotally couples the cantilever beam to a roller support.

6. The articulating roller assembly as set forth in claim 5, wherein:

the roller support is comprised of:

a channel for mounting the roller support onto a frame of an enclosure;

a set of apertures for securely fastening the mounted roller support to the frame of the enclosure.

7. The articulating roller assembly as set forth in claim 5, wherein:

the roller support houses an adjustment shaft for vertical adjustment of the cantilever beam in relation to the roller support.

8. The articulating roller assembly as set forth in claim 7, wherein:

the roller support is inserted within a periphery notch of a frame of a door;

with the adjustment shaft positioned at an interior facing side of the door, with the roller positioned at an exterior facing side of the door.

9. The articulating roller assembly as set forth in claim 7, wherein:

the connecting distal end of the throw section is pivotally coupled with the adjustment shaft, enabling the throw section to rotate and swing along a reciprocating path within a cavity of the roller support.

10. The articulating roller assembly as set forth in claim 8, wherein:

the adjustment shaft supports the throw section, which rotates about a longitudinal axis of the shaft.

11. An articulating roller assembly for maximizing travel span and stability of a shower door operation, comprising:

a cantilever beam that includes:

a throw section having a longitudinal axis that maintains a fixed perpendicular distance between a raceway of a support rail and the shower door;

the throw section stabilizes out-of-plane motions of the shower door, and delimits in-plane vertical motions thereof;

a span section that supports a set of wheels coupled at a first and second distal ends of the span section with sufficient longitudinal separation between wheels;

the span section is oriented transverse the throw section; and the first distal end of the span section and a distal end of the throw section form a bend of the cantilever beam where the span section commences at the distal end of the throw section and extends in one direction, with the span section having a length that is longer than the throw section;

the throw section includes a pivot portion that enables the cantilever beam to rotate along a reciprocating path when the throw section rotates during operation of the cantilever beam.

12. An articulating roller assembly for maximizing travel span and stability of a shower door operation as set forth in claim 11, wherein:

the pivot portion of the throw section includes a connecting distal end that pivotally couples the cantilever beam with an adjustment shaft of a roller support.

13. A shower enclosure, comprising:

a track having a straight section and a curved section;

a curved door associated with the track by a beam that moves through the straight and curved sections of the track;

the beam includes:

a throw section and a span section with the span section having a length that is longer than the throw section;

the throw section is oriented transverse the span section and includes a pivot portion associated with the curved door that enables the beam to rotate along a reciprocating path during travel of the curved door along the straight and curved sections of the track;

a first distal end of the span section and a distal end of the throw section form a bend of the beam where the span section commences at the distal end of the throw section and extends in one direction away from an apex of the curved door.

* * * * *